US008857567B1

(12) United States Patent
Raymond

(10) Patent No.: US 8,857,567 B1
(45) Date of Patent: Oct. 14, 2014

(54) SELF-CONTAINED POWERED JIB BOOM AND OPTIONAL WORK PLATFORM ATTACHMENT FOR MOBILE CRANES

(71) Applicant: Timothy James Raymond, Bradenton, FL (US)

(72) Inventor: Timothy James Raymond, Bradenton, FL (US)

( * ) Notice: Subject to any disclaimer, the term of this patent is extended or adjusted under 35 U.S.C. 154(b) by 0 days.

(21) Appl. No.: 13/918,860

(22) Filed: Jun. 14, 2013

Related U.S. Application Data

(60) Provisional application No. 61/689,801, filed on Jun. 14, 2012.

(51) Int. Cl.
*B66F 11/04* (2006.01)

(52) U.S. Cl.
CPC ..... *B66F 11/046* (2013.01)
USPC ..... 182/2.1

(58) Field of Classification Search
CPC ..... B66F 11/04; B66F 11/046
USPC ..... 182/2.1–2.4, 2.7–2.11
See application file for complete search history.

(56) References Cited

U.S. PATENT DOCUMENTS

| | | | | |
|---|---|---|---|---|
| 4,331,215 | A * | 5/1982 | Grove et al. | 182/2.1 |
| 4,518,059 | A * | 5/1985 | Frey-Wigger | 182/2.7 |
| 4,537,281 | A | 8/1985 | Endres | |
| 4,553,632 | A | 11/1985 | Griffiths | |
| 4,653,654 | A | 3/1987 | McDaniel, Jr. et al. | |
| 4,754,840 | A * | 7/1988 | MacDonald et al. | 182/2.3 |
| 4,799,573 | A | 1/1989 | Simnovec et al. | |
| 6,036,035 | A | 3/2000 | Asano et al. | |
| 6,250,485 | B1 * | 6/2001 | Olson | 212/260 |
| 6,585,079 | B1 * | 7/2003 | Weyer | 182/2.7 |
| 6,588,448 | B1 | 7/2003 | Raymond | |
| 6,679,284 | B1 | 1/2004 | Raymond | |
| 6,823,888 | B1 | 11/2004 | Raymond | |
| 7,926,670 | B2 | 4/2011 | Schneider | |
| 8,443,936 | B1 * | 5/2013 | Raymond | 182/2.1 |
| 2002/0144862 | A1 * | 10/2002 | Engvall et al. | 182/18 |
| 2009/0101435 | A1 * | 4/2009 | Higgins | 182/2.1 |
| 2010/0204713 | A1 * | 8/2010 | Ruiz Morales | 606/130 |

* cited by examiner

*Primary Examiner* — Charles A Fox
*Assistant Examiner* — Kristine Florio
(74) *Attorney, Agent, or Firm* — Dorothy S. Morse

(57) ABSTRACT

A powered rotating and articulating self-contained jib boom of both swing jib and non-swing jib design that attaches to mobile cranes and functions as an aerial lift when fitted with an optional work platform. Since it pins onto any existing crane by attachment to a standard swing-jib mounting system using the four pinning holes and pins located on the crane's outer most boom tip sheave head, it achieves powered leveling and rotation of a platform without having to modify or add components to the existing crane. Also, with the crane jib boom hydraulically powered for rotation in the horizontal plane up to 360-degrees and articulation in a 90-degree vertical plane, an attached work platform can be kept level during up/down articulation of the crane boom in its vertical plane. Furthermore, with dielectric insulation, the jib boom, crane boom, and attached work platform are usable on live electrical line work.

20 Claims, 25 Drawing Sheets

SELF-CONTAINED POWERED JIB BOOM AND OPTIONAL WORK PLATFORM ATTACHMENT FOR MOBILE CRANES

CROSS-REFERENCES TO RELATED APPLICATIONS

The applicant herein requests domestic priority for the instant application based upon his earlier filed U.S. provisional patent application for similar subject matter, which has a title of "Crane attachment insulated aerial lift jib boom with platform", a U.S. provisional application number of 61/689,801, and a filing date of Jun. 14, 2012.

BACKGROUND

1. Field of the Invention

This invention relates to jib booms used with cranes and telescopic boom assemblies, particularly to a hydraulically powered jib boom (of both swing jib and non-swing jib design) with an optional self-contained work platform attachment having auto-powered leveling and 360-degree rotation that can be used with mobile cranes and boom truck cranes, wherein when such mobile and boom truck cranes include a swing-jib mounting system, the invention can be mounted to the standard crane tip swing-jib mounting plates already incorporated thereon, advantageously using the existing pinning holes and pins provided by the swing-jib boom system's manufacturer and without any added adaptation or modification to the crane. It is also contemplated for the present invention to be used with telescopic boom assemblies, and similarly where the telescopic boom assembly incorporates a swing-jib attachment system, the present invention becomes securely mounted to a boom assembly using only the previously mentioned swing-jib mounting plates and pins, and does not require any additional bolting, welding, or attachment of any other fixtures. Thus, the auto-powered leveling and rotation capability of the present invention, among its other features and advantages, can instantly transform any crane with a swing-jib attachment system into a modern day state-of-the-art aerial lift with an articulating boom section, which has not been done before. If desired, after its initial attachment to a mobile crane or boom truck crane, the present invention jib boom can remain permanently attached to the crane's main boom during road travel, which provides the important time-saving advantage of allowing an operator to instantly operate the jib boom after arrival at a new work location once the crane's outriggers are set. The present invention jib boom design also allows hydraulic rotation 360-degrees, which aligns it alongside its connected crane boom within the permitted envelope required for legal road travel. This continued connection of the present invention jib boom to a crane boom during road travel saves much labor, as current jib booms require many manual steps of attachment and detachment each time the connected crane is moved, as are identified below in this disclosure. Additional time saving is experienced when a work platform is attached to the distal end of the present invention jib boom, as personnel may enter the platform from the bed of the crane and instantaneously deploy the booms to position the platform in the desired elevated work area, and similar to the option of permanent attachment for the jib boom, a work platform connected to present invention jib boom may also have permanent attachment to it and does not have to be removed prior to road travel. Another advantage of the present invention jib boom is that its work range is not restricted to a linear line, as in the current state of art which only allows a jib boom to be attached to the crane so that the jib boom is in line with the crane boom. In contrast, the rotation feature of the present invention jib boom allows it to rotate in a horizontal plane regardless of the crane's boom angle, allowing the jib boom to wrap around objects in the work area, a distinct advantage over the prior art. The present invention jib boom also incorporates an articulating mechanism that enables it to articulate in the vertical plane regardless of the crane's boom angle. The rotation and articulating features together enable a crane with an attached present invention jib boom (with or without a platform) to be positioned and articulated in a manner that is not possible with the current state-of-art crane jib booms, providing a greatly increased work area envelope with more side reach and greater height. Since the present invention jib boom can hydraulically articulate, automatic leveling of it and an optionally attached work platform takes place as the crane boom is raised and lowered. In addition, the onboard powered-leveling systems of the present invention jib boom and work platform attachment maintain the jib boom and work platform in a level orientation as the attached crane boom is articulated up or down, regardless of the location of its load's center of gravity relative to the platform, including cantilevered and off-set loads. The present invention jib boom rotation mechanism also allows 360-degree platform rotation when fully-loaded, with the option of stable and balanced vertical articulation leveling and work platform rotation at the same time. Further advantages of the present invention include, but are not limited to, a redundant ground-operated radio remote control system having the same functions as the control box on the work platform, work platform positioning above the boom and boom tip that allows unrestricted work access above and around the crane boom tip, and legal road travel for the jib boom and work platform, as when the crane boom to which a present invention jib boom and work platform are attached is stowed over the chassis deck bed of a mobile crane or boom truck crane, the very compact and low profile design of the present invention jib boom and work platform allow it to fit within the permitted legal-road-travel envelope while it is secured to the boom tip swing-jib mounting plates (also referred to elsewhere herein as 'swing-jib brackets'). In addition, since the present invention jib boom is a self-contained and fully functioning jib boom, it could also be attached to cranes and telescopic boom assemblies without a swing-jib attachment system, however, crane modification (bolting, welding, and/or other) is typically required to provide a secure jib boom attachment point.

2. Description of the Related Art

The mobile crane boom industry has advanced many new crane designs and other product technology over the last 15 years by adding new features and design improvements, such as stronger materials, onboard load-monitoring computers, optional radio remote controls that allow operation of all crane functions from the work platform, load-sensing computerized hydraulic systems, and much more. One area that has not advanced is swing jib booms, and those in use today are basically the same as 40 years ago. A description of what historically has been, and still is, standard for the crane industry regarding removable or pin-on jib booms follows below. Some disadvantages of this prior art are also mentioned below, along with information relating to dedicated work platforms having structure specific to a particular manufacturer or model.

The standard swing-jib boom currently used with boom truck cranes incorporates a four pin attachment system, which requires a lot of labor to attach and detach the jib boom. The procedural steps for prior art swing-jib boom attachment typically are: 1) Position the crane booms to one side of the truck chassis and deploy downward so that the crane tip sheave head is about 4-feet off ground, making the sheave head easily accessible for the operator to proceed with swing-jib boom attachment. 2) Retract the telescopic booms to allow holes on one side of two steel mounting plates located on the crane boom sheave head tip to line up with complementary holes on steel plates attached to the swing-jib boom while it remains supported by stowage brackets attached to the crane's main outer boom. 3) After aligning holes on the sheave head mounting plates with holes on the steel plates attached to the swing-jib boom, drive two tapered mounting pins through the aligned holes, which will act as a hinge point. 4) Tie a rope to the other (distal) end of the swing-jib boom. 5) Remove the restraints holding the swing-jib boom in place. 6) Raise the crane boom to a level position. 7) Using the rope manually pull the swing-jib boom 180-degrees about the hinge point. 8) Line up the unconnected holes in mounting plates on the crane boom sheave head tip with the remaining unconnected holes in the steel mounting plates attached to the swing-jib boom and drive the two remaining tapered mounting pins into the newly-aligned holes. 9) Remove the pull rope, and the swing-jib boom is now ready for use. In contrast, the present invention jib boom attachment has a hydraulically-powered rotation bearing drive assembly to mechanically rotate the jib boom to any position in a horizontally-extending plane. Thus, when the four tapered mounting pins are connected to the present invention jib boom assembly and the main crane boom sheave head tip, the present invention jib boom attachment can remain at least partially connected to the main crane boom while the hydraulically-powered rotation bearing drive assembly positions it anywhere in a 360-degree rotation range, including the preferred travel position alongside the crane's main boom within road legal width and height requirements.

The present invention jib boom attachment is also distinguishable from the manufacturer-dedicated jib booms currently in use with mobile crane booms. Mobile crane boom manufacturers do not currently offer, nor are mobile crane booms designed for, a factory-ready (or an after-market) self-contained jib boom that employs, adapts, and/or otherwise incorporates modern aerial lift features with powered rotation and jib boom self-leveling, and any attempt to do so by means other than the self-contained and self-powered jib boom attachment herein would require modification of the entire mobile crane boom assembly to supply the associated work platform with power (hydraulic or electric) for its needed jib boom leveling and rotational features, and would also require a new mechanically-designed platform mounting structure and assembly. Furthermore, for well over twenty years, many aerial lift boom trucks have had articulating booms with work platforms or baskets that allow them to function as aerial man lifts. While these articulating boom aerial lifts have many features and mechanisms that are similar to those of the instant invention, such as powered mechanical articulation and rotation, these aerial lifts are also designed and manufactured with many dedicated/integral components that work only with their own specifically designed product, and cannot be easily adapted for other use, such as being an after-market attachment to a mobile crane or boom truck crane. Furthermore, such aerial lift articulating booms are not self-contained, and power from the associated truck is needed for its work platform leveling and rotation functions. Thus, such prior art articulating booms are not designed to function as an after-market add-on jib boom and work platform attachment, as is the present invention, instead being an original and dedicated integral component of its associated aerial lift boom truck. In addition, these aerial lift boom trucks do not have a swing-jib or a boom tip designed sheave head configured for a swing-jib, and thus do not secure their booms or platforms in position using a standard swing-jib pinning system. Instead, they are all designed to be connected to attachment points specifically designed for support of their individual work platforms. Furthermore, in prior art and current aerial lift boom trucks, hydraulic or electrical power for work platform leveling and rotation is typically supplied from the ground by the supporting vehicle, an auxiliary engine, or a large battery-powered power unit, via hose/cable carriers or retractable reels attached to the boom assemblies, none of which are required during use of the self-contained self-powered present invention embodiments.

Thus, in contrast to the prior art, the present invention comprises the following features and advantages which make it structurally distinguishable. Leveling of the present invention jib boom with or without a work platform is accomplished by means of an onboard mechanically-powered automatic hydraulic/electronic leveling system that senses an out-of-level state in the jib boom or its attached work platform, and then operates a hydraulic leveling cylinder to articulate the jib boom with or without a work platform level while the crane boom is raised or lowered, regardless of the position of the work platform, onboard personnel, or its payload. When the crane boom is stopped, the jib boom's leveling cylinder employs several holding valves that lock the work platform into a level orientation. Thus, a loaded present invention jib boom can be safely rotated in the horizontal plane while it is in the locked position, and its load, including personnel, are also safe as a result of its powered-leveling while the boom is being raised or lowered. Also, in addition to powered-leveling, rotation will now be available on mobile cranes due to other integral design features of the present invention, including its strong rotational drive bearing assembly, a torsion-resistant tubular jib boom support structure, and a rigid and strong planar mounting bracket that anchors the present invention jib boom to the strong structural swing-jib sheave head while transferring all torsion and bending moments induced by off-set jib boom loads to the main crane boom's swing-jib sheave head.

In contrast to the current prior art mobile crane jib booms which lack any form of rotation, the present invention jib boom with or without an attached work platform advantageously incorporates a hydraulic-powered rotation bearing drive assembly that allows it to rotate in a 360-degree horizontal plane, with the present invention jib boom and an attached work platform being maintained automatically in a level state (or locked into a level orientation) during all of its 360-degree rotation range, and as the attached main crane boom is raised or lowered. Also, optionally, after the main crane boom stops vertical articulation, the level orientation of the present invention jib boom and an attached work platform can be locked during subsequent rotation with stops in its linear leveling actuator. Furthermore, the total power supply, mechanical actuation, and function controls in the self-contained most preferred embodiments of the present invention are all encompassed in a self-contained 12-volt battery-powered power pack integral with its jib boom assembly, thus eliminating the need for connecting hoses or power cables alongside the booms or an attached work platform, as well as eliminating the need for hose reels or cable carriers, unless applications dictate otherwise. In addition, a shear ball bearing and hydraulic gear drive mechanism in the present invention allows a dielectric-rated insulated jib boom and attached work platform to be used much like that of an aerial lift boom truck for working on live power lines. The universal-style mounting design of the present invention also allows it to be mounted to most commercial crane boom ends having a swing-jib mounting system, as the present invention is configured to use the swing-jib anchor points that most cranes now incorporate as a standard feature. As mentioned hereinabove, the prior art swing-jib mounting system allows for a simple four pin connection of the present invention jib boom and attached work platform to a main crane boom tip. In addition, the mechanically-powered leveling feature of the present invention jib boom allows for road-ready-stowed travel while at least partially attached to the main crane boom sheave head tip, enabling the attached jib boom to be rotated outboard into a substantially parallel position alongside a main crane boom within road-legal width and height requirements, while concurrently clearing the cab chassis roof and driver's vision, thus allowing the present invention jib boom with or without an attached work platform to remain connected to the main crane's boom tip during road travel to a next work site, saving significant set-up time at the next work location after the crane's outriggers are set.

The inventions thought to be most related in structure to the present invention, yet distinguishable, are those disclosed in U.S. Pat. No. 4,553,632 to Griffiths (1985), U.S. Pat. No. 7,926,670 to Schneider (2011), U.S. Pat. No. 4,537,281 to Endres et al. (1985), U.S. Pat. No. 4,653,654 to McDaniel, Jr. et al. (1987), U.S. Pat. No. 6,036,035 to Asano et al. (2000), U.S. Pat. No. 4,799,573 to Simnovec et al. (1989), and the three prior U.S. patents to the inventor herein for differing embodiments of a telescopic boom-mounted concrete pump apparatus having a pivotal jib boom member [U.S. Pat. No. 6,588,448 to Raymond (2003), U.S. Pat. No. 6,679,284 to Raymond (2004), and U.S. Pat. No. 6,823,888 to Raymond (2004)]. The Griffiths patent discloses an automatic leveling device for crane-boom-supported work baskets that senses and adjusts leveling via plumb sensors and potentiometers. The Griffiths invention also includes a battery that supplies power to an electronic leveling sensor, a servo valve, and an actuator for occasions when the basket needs to be electrically isolated from the ground. In 1983, when the Griffiths patent application was filed, others were making and using electronic leveling sensors on work baskets/platforms, such as those available from P-Q Controls in Bristol, Conn., but these baskets/platforms did not have onboard battery power. Also, after reading about the Griffiths invention, it is concluded that its basket is an integrally designed and incorporated part of its associated boom crane, as the Griffiths disclosure does not include any supportive layout instructions or design plans that would enable its basket to be an after-market work platform attachment. The Schneider invention discloses a gravity-leveling work platform that can be attached to the tip of a swing-jib crane boom and stowed for road-legal highway travel, however, the Schneider invention does not teach a work platform with the many features and advantages provided by the also stowable and road-legal present invention platform attachment. The Endres invention is a yoke-mounted platform having a gravity/pendulum leveling design and a brake that locks the leveled platform in-place when the boom is stopped, so that people can safely move around inside the platform without a risk of placing the platform in an out-of-level orientation. The Endres platform also incorporates a shock absorber that slows rotation of its arms 82 and 84 around pivot pins 94/96, which that could occur as a result of unbalancing movement by onboard personnel or payload before its lock/brake is released. After the 1985 Endres invention, newer art has similarly used a hydraulic cylinder with a fluid loop path from its extend side port to its retract side port (a plumbed-in line between the two ports being some sort of on/off hand-valve that stops fluid travel), which stops travel of the cylinder shaft and locks the work platform against further movement. Although the shock absorber of the Endres invention is important for those moving around inside its work platform (to prevent them from tipping out when any unbalanced movement occurs), a shock absorber feature is unnecessary in the present invention as a result of its onboard powered-leveling system. The McDaniels invention is a side-mounted gravity-leveled work platform that uses the swing-jib sheave head pinning point to attach itself to a crane boom. The side-mounted gravity-leveling system uses the same type of art employed in the Endres yoke-mounted platform system for leveling and locking its platform, which is distinguishable from the non-gravity-leveled present invention. The Simnovec invention is a self-leveling work platform with an overhead connection to a crane boom, and appears to be designed for a knuckle boom or an aerial lift boom. In contrast to the present invention, the Simnovec platform requires boom modification prior to its attachment. The McDaniels invention is a side-mounted gravity-leveled work platform that uses the swing-jib sheave head pinning point to attach itself to a crane boom. The side-mounted gravity-leveling system uses the same type of art employed in the Endres yoke-mounted platform system for leveling and locking its platform, which is distinguishable from the non-gravity-leveled present invention. The Simnovec invention is a self-leveling work platform with an overhead connection to a crane boom, and appears to be designed for a knuckle boom or an aerial lift boom. In contrast to the present invention, the Simnovec platform requires boom modification prior to its attachment. Also distinguishable from the present invention are the inventions disclosed in three prior U.S. patents to Raymond (now assigned to others) for a telescopic boom-mounted concrete pump apparatus, as its jib boom is designed for horizontal movement within a building to discharge concrete close to the location of the truck, with its pivoting capability used to maneuver it around columns, pillars, and other obstacles encountered within a building while attempting to reach the location requiring concrete. The three prior Raymond disclosures do not teach the self-contained and easily detachable present invention jib boom with its auto-powered leveling and rotation, and its attached work platform which instantly transforms any crane with a swing-jib attachment system into a modern day state-of-the-art aerial lift, with hydraulic articulation and automatic leveling of the present invention jib boom and an attached work platform able to occur as the crane boom is articulated up or down regardless of the location of its load's center of gravity relative to the work platform, including cantilevered and off-set loads, to provide a greatly increased work area envelope with more side reach and greater height. Also, with the work platform positioned above the boom and boom tip when its attached jib boom is articulated, unrestricted work access is possible above and around the crane's boom tip. The present invention jib boom rotation mechanism also allows 360-degree work platform rotation when fully-loaded, with the option of stable and balanced vertical articulation leveling and work platform rotation at the same time. Furthermore, the present invention jib boom articulating mechanism enables it to articulate in the vertical plane regardless of the crane's boom angle, while its rotation feature allows it to rotate 360-degrees in a horizontal plane regardless of the crane's boom angle, allowing the present invention jib boom to more easily wrap around objects in a work area. No other jib boom with optional work platform attachment for mobile and boom truck cranes is known to be self-contained and detachable, and also have the same structure or function, or to provide all of the features and advantages of the present invention.

BRIEF SUMMARY OF THE INVENTION

It is the primary object of this invention to provide a state-of-the-art universal and self-contained powered self-leveling and rotating jib boom equipped with or without a work platform attachment for mobile cranes and boom truck cranes with a swing-jib mounting system, which becomes quickly and securely mounted to the standard crane tip swing-jib mounting plates using the existing pinning holes and mounting pins provided by the manufacturer of the swing-jib boom system. It is also an object of this invention for its jib boom to articulate through a vertical plane of 90-degrees and have 360-degrees of rotation in a horizontal plane so that when a work platform attachment is also used, the present invention can instantly transform any crane with a swing-jib attachment system into a modern day state-of-the-art aerial lift. Another object of this invention is for the 360-degree rotation of its jib boom to occur regardless of the boom angle of the crane supporting it. Yet another object of this invention is for its jib boom and an attached work platform to optionally be dielectrically insulated for power line work. It is also an object of this invention for powered self-leveling to occur during articulation of its jib boom an the main crane boom supporting it, and for its leveling cylinder to have multiple stops that can be used after vertical articulation to lock the orientation of the jib boom and a connected work platform during their rotation. It is a further object of this invention to provide a self-contained jib boom with optional work platform attachment that is also attachable to mobile and boom truck cranes not having a swing-jib mounting system, through use of bolting, welding, or attachment of other fixtures to the crane boom. It is also an object of this invention to provide a self-contained jib boom attachment that can be used with telescopic boom assemblies. Another object of this invention is to provide a self-contained jib boom with optional work platform attachment that incorporates onboard mechanical, hydraulic, or electric actuator-powered leveling systems that, as the main crane boom is articulated up or down, maintain a level orientation for the jib boom, work platform attachment, and any load associated therewith regardless of the location of the load's center of gravity relative to the work platform, including cantilevered and off-set loads. It is a further object of this invention to provide jib boom rotation via an onboard hydraulic, electric, or manual rotation mechanism, but also to provide redundant and back-up features that enhance safety of onboard personnel and payloads. It is also an object of this invention to provide a self-contained jib boom attachment, with or without an attached work platform, which is capable of road-legal travel while remaining connected to the main crane boom tip's swing-jib mounting plates and stowed alongside the main crane boom on stowage brackets connected externally to the main crane boom. Other objects of this invention include quick and easy operator access to a work platform connected to its jib boom from the bed of a mobile crane truck, time-savings as a result of operator capability to instantly operate the jib boom after arrival at a new work location once the crane's outriggers are set, a work range that is not restricted to a linear line, and an increased work area envelope with more side reach and greater height above and around a crane boom tip than is possible with prior art jib booms.

In contrast to the prior art and although connection to a crane boom without swing-jib mounting plates is contemplated, the present invention preferably attaches to the standard crane tip swing-jib mounting plates already incorporated on a crane boom end without any adaptation or modification to the crane, and thereby quickly achieves a fully operational condition using only the four mounting pins supplied with the crane, and it may remain on the crane boom and still be within the envelope allowed for road legal travel (compliant in both road-ready width and height dimensions). The present invention also incorporates many state-of-the-art aerial lift work platform features, including automatic powered self-leveling during main crane boom and jib boom articulation. The self-contained present invention embodiments also have an onboard state-of-the-art hydraulic power package that incorporates off-the-shelf commercially available components, such as deep-cycle large-amp-hour marine batteries and a unitized power-pack consisting of a direct current (DC) motor, gear pump, fluid reservoir, and proportional electric/hydraulic solenoid valves. It also incorporates a state-of-the-art electronic level sensor and leveling actuator controlled by an electronic control box with hand-operated electric joy sticks and switches that control auto-leveling, leveling override, and jib boom rotation, in addition to an on/off switch used for manual adjustment of the level of jib boom's attached work platform, if needed, and a foot-actuated on/off switch to enable the auto-leveling operation. To meet aerial lift safety codes, the present invention work platform control system incorporates a redundant ground-operated remote radio-operated control system (having the same functions as the control box on the work platform) that allows personnel on the ground to control the work platform leveling and rotation operations. When a work platform is attached to the end of its jib boom, an additional feature of the present invention is the option to have the jib boom and work platform dielectrically insulated for power line work. In addition, the control package of the present invention also includes a low-voltage back-up system with toggle switches (preferably 3-position) that are used to control the leveling and rotation of the present invention work platform attachment should battery voltage drop below 10.5 volts. The toggle switches and the back-up DC power system can be used to continue normal operation of a present invention work platform, while it moves downwardly to the ground for battery replacement.

Although the universal and self-contained jib boom and work platform attachment of the present invention is conveniently secured to new cranes or after-market cranes by using the crane manufacturer's swing-jib mounting system, it is not limited to this type of mounting. If desired, and with the crane manufacturer's prior approval, the boom tip end of various crane booms without a swing-jib system, and other telescopic boom assemblies, can be modified to accommodate attachment of the present invention when use of a fully self-contained work platform is desired. Furthermore, the powered-leveling actuator of the present invention may comprise, but is not limited to, any of the current art forms, such as a hydraulic cylinder, or a hydraulic or electrical linear rotary-screw actuator. Present invention jib boom rotation may also be accomplished using current art, such as but not limited to, a slewing ring bearing used with a hydraulic (or electric) gear or worm-drive mechanism, or a hydraulic helical-rotation assembly. The self-contained DC power unit of the present invention, with its onboard and self-contained jib boom controls, is desired and preferred in many applications to achieve easy and convenient non-modified crane boom attachment (via use of a commonly available swing-jib mounting system). However, when the present invention is secured to a crane boom via manufacturer installation or by after-market crane modification (but without the use of a swing-jib mounting system), hydraulic or electric power for jib boom leveling and rotation functions may be supplied from the crane's base unit or other remote systems by routing hoses or electrical cable to the jib boom and an attached work platform by means of a hose/cable carrier or hose/cable reels.

DETAILED DESCRIPTION OF PREFERRED EMBODIMENTS

The description herein provides preferred embodiments of the present invention but should not be construed as limiting its scope. Instead, the scope of the present invention should be determined by the appended claims and their legal equivalents, rather than being limited to the examples given.

Figure 1:
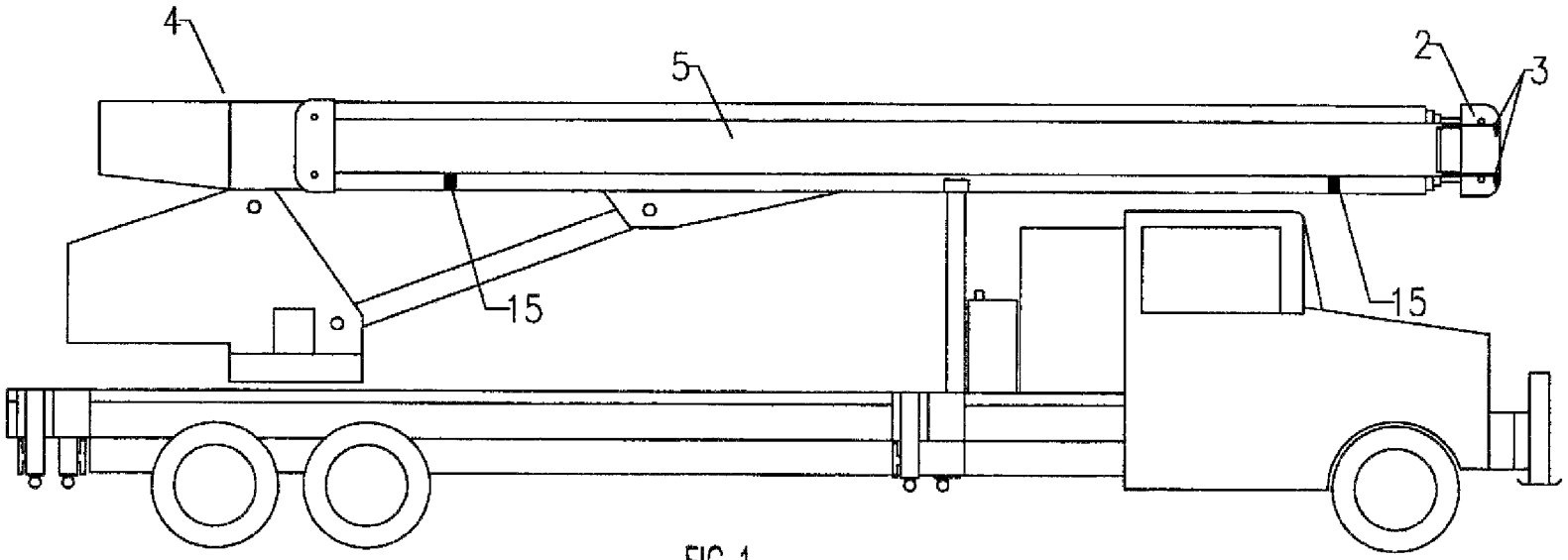
FIG. 1 PRIOR ART
FIG. 1 is a side elevation view of a prior art fully-operational mobile telescopic boom crane truck that is a fully designed and engineered machine capable of lifting, telescopic motion, and rotation of large loads within a work area determined by a load chart and work range chart, and which also shows a disconnected prior art swing-jib boom secured to the side of the truck's main crane boom on spaced-apart stowage brackets and in a road-travel-ready stowed position, and the swing-jib sheave head mounting plates on the crane boom tip having nothing attached to it.
Figure 19:
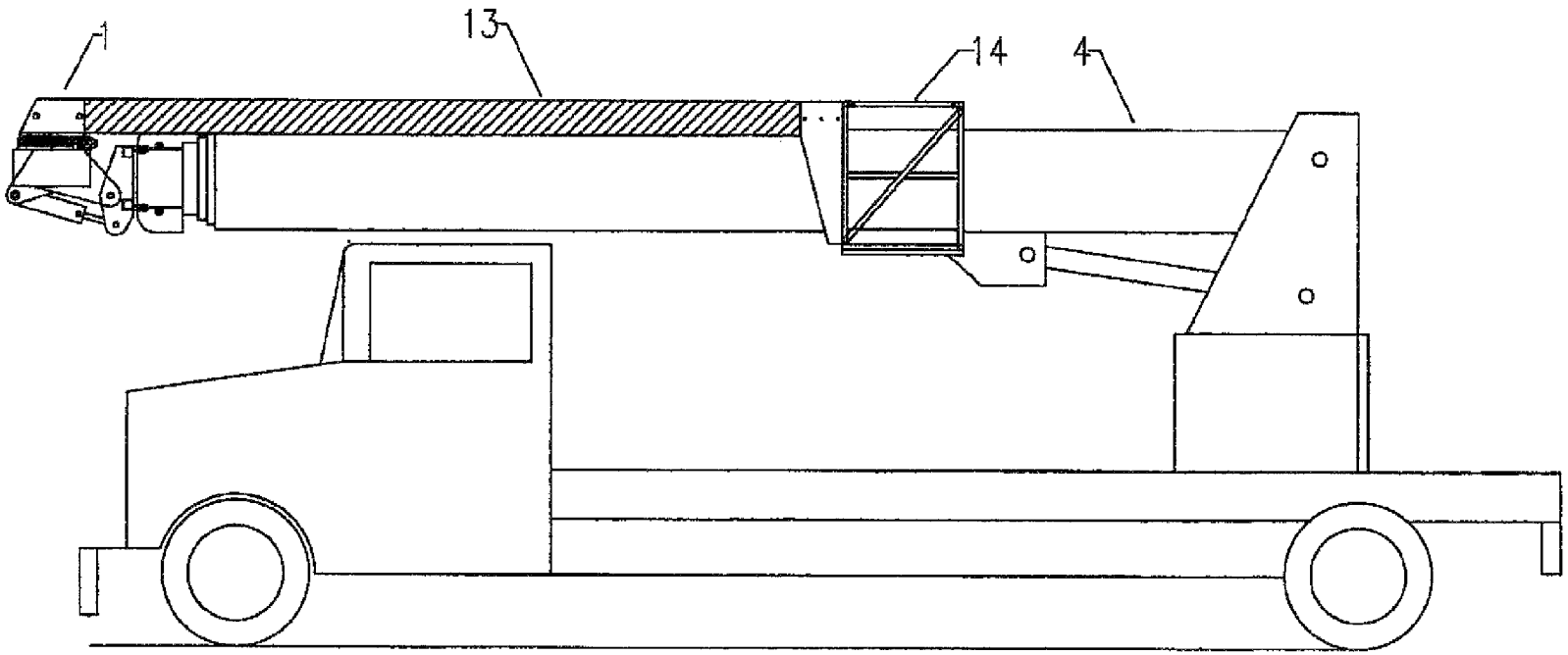
FIG. 19 is a side elevation view of a second preferred embodiment of the present invention having a jib boom attachment (including a work platform) made from a dialectical insulated composite material, the dialectical insulated jib boom attachment secured to the sheave head on the main crane boom of a mobile telescopic boom crane truck and both the jib boom and main crane boom in stowed road-legal positions, the work platform used for transferring personnel to work areas with live electrical power lines and distribution stations, this insulated jib boom feature in combination with the present invention's rotation, articulation, and self-leveling features allowing a non-dielectric steel crane to perform in a manner similar to that of a state-of-the-art insulated aerial lift boom truck, and since the present invention jib boom in its travel orientation remains fully connected to the main crane boom sheave head tip, it is fully operational upon arrival at a work site without any additional set-up labor required, contrary to that needed when current state-of-the-art jib booms are used and moved to a new location.
Figure 20:
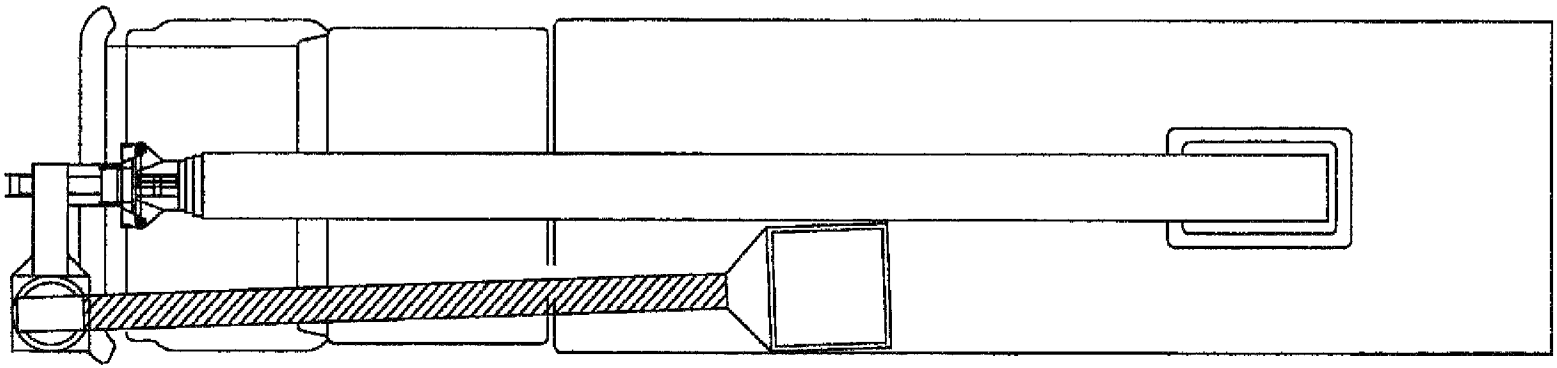
FIG. 20 is the top view of the present invention jib boom attachment (including a work platform) made from a dialectical insulated composite material and mobile telescopic boom crane truck shown in FIG. 19.
Figures 21A, 21B:
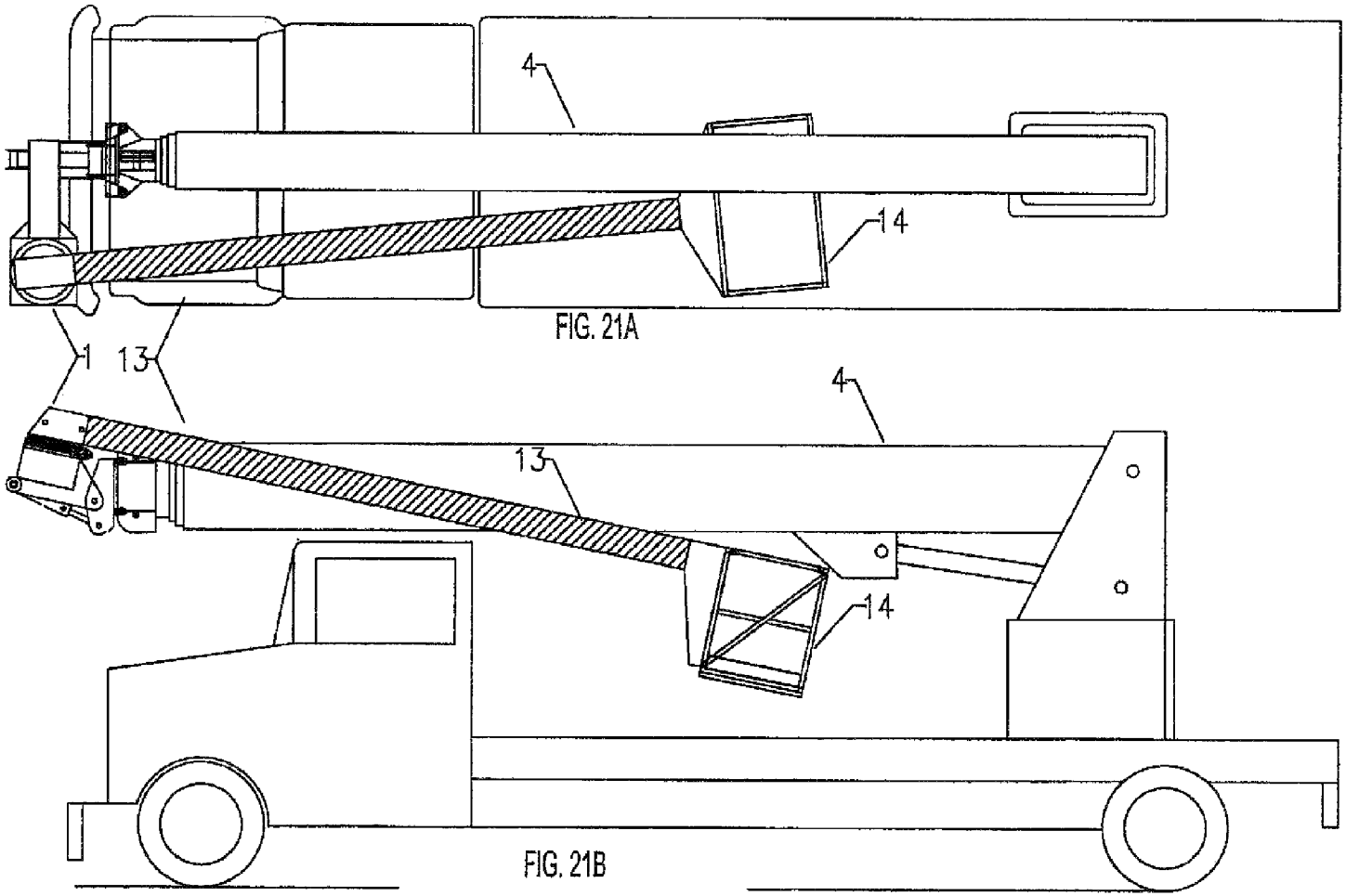
FIG. 21A is a top view of the second preferred embodiment of the present invention similar to that in FIG. 20, but showing the jib boom attachment downwardly articulated to allow its attached work platform to remain a small distance off the truck deck bed, allowing easier and more direct access by personnel to the work platform wherein access is gained from the truck deck bed instead of via a ladder.
FIG. 21B is a side elevation view of the jib boom, work platform, and mobile telescopic boom crane truck shown in FIG. 21A with the jib boom attachment downwardly articulated so that in its stowed position ready for road travel the attached work platform is positioned partially under main crane boom.

This invention provides a universal and ready-to-use self-contained jib boom attachment 1 (including at a minimum jib boom tube 13, jib boom support structure 12, jib boom mounting bracket 6, and optional work platform 14) that is primarily intended for use with mobile and boom truck cranes, such as but not limited to those shown in FIGS. 1 and 19, which enables use of jib boom tube 13 as an articulating and rotating extension of the crane's main boom 4 for easy movement of jib boom tube 13 and optional work platform 14 around objects and obstacles confronted in aerial work sites, to provide better access of onboard personnel to many parts of the elevated work site without having to reposition the vehicle supporting main crane boom 4. The present invention jib boom attachment 1 uses standard off-the-shelf components, and when fitted with an optional work platform (such as but not limited to that shown in FIG. 22 and marked with the numerical designation 14), jib boom attachment 1 functions as an aerial lift having hydraulic articulation in a 90-degree vertical plane while jib boom tube 13 and work platform 14 experience powered self-leveling, even with moving, off-set, and cantilevered loads. When jib boom tube 13 and work platform 14 are dielectric insulated, the personnel they carry to elevation can perform live electrical line work. When the present invention's jib boom attachment 1 is secured to mobile and boom truck cranes (see FIGS. 1 and 19 for examples) having a current state-of-the-art manually operated swing-jib boom 5 and a swing-jib mounting system with mounting plates 2 already secured on the end of its main crane boom 4, as is preferred for the connection convenience and simplicity provided, jib boom attachment 1 can be quickly and easily secured to mounting plates 2 using only the existing pinning holes therein and the mounting pins 3 provided by the prior art swing-jib boom 5 manufacturer, without any added modification or alteration to main crane boom 4.

Although not shown in the accompanying illustrations, it is also contemplated for the present invention to be used with telescopic boom assemblies, and for jib boom tube 13 to become securely mounted thereto using only the previously mentioned mounting plates 2 and mounting pins 3, and does not require any additional bolting, welding, or attachment of any other fixtures to a crane boom 4, or to a crane boom 4 tip end that incorporates a swing-jib mounting system with mounting plates 2. In addition, although not shown, it is considered within the scope of the present invention to have connection to cranes and telescopic boom assemblies not having a swing-jib attachment system, however crane modification (bolting, welding, and/or other) is typically required to provide a secure jib boom tube 13 attachment point. Furthermore, the auto-powered leveling system of present invention jib boom attachment 1 includes at a minimum a linear leveling actuator 7 connected between jib boom rotation base 8 and jib boom mounting bracket 6, an electronic leveling sensor 22, and a hinge pivot point 9. Although not shown, preferred embodiments of the present invention with an attached work platform 14 may also include a low-voltage back-up system with toggle switches (preferably 3-position) that are used to control the leveling and rotation of electrically-powered present invention jib boom tubes 13 having an attached work platforms 14 should battery voltage drop below 10.5 volts. The auto-powered leveling maintains jib boom attachment 1 in a level orientation while main crane boom 4 is articulated up and down, with jib boom tube 13 maintaining a level orientation regardless of its horizontal rotational position, and also regardless of the location of the center of gravity in any load (not shown) relative to it or an attached work platform 14, including cantilevered and off-set loads. The present invention jib boom attachment 1 also incorporates a rotation mechanism (see FIGS. 12 and 23), which includes at a minimum a rotation bearing drive assembly 10 connected between the jib boom rotation base 8 and the torsion-resistant jib boom support structure 12, that allows a fully-loaded jib boom attachment 1 to rotate in a horizontal plane through 360-degrees while stable and balanced leveling of jib boom tube 13 and optional work platform 14 also occurs, with vertical articulation and rotation optionally occurring at the same time or rotation occurring while stops in linear leveling actuator 7 lock the orientation of jib boom attachment 1 and a connected work platform 14. Further advantages of the present invention are a redundant ground-operated radio remote control system 21 (see FIG. 12) having the same back-up manual leveling and rotation functions available to personnel in the optional work platform 14, with radio remote control system 21 allowing personnel on the ground to remotely conduct leveling and rotation operations of jib boom attachment 1 with or without the optional work platform 14 attached. The present invention jib boom attachment 1 offers a very compact and low profile design, and road-legal travel while stowed (with or without an attached work platform 14) at least partially on the main boom 4 tip's swing-jib sheave head mounting brackets 2, which provides the important time-saving advantage of allowing an operator to instantly operate the jib boom after arrival at a new work location once the crane's outriggers are set. The stowed position of work platform 14 can also be close to an attached truck bed to allow personnel quick access to work platform 14 from the truck bed (instead of having to climb a ladder, as in the prior art). While FIGS. 1-4 show prior art manually-installed jib booms 5 for comparison to the present invention, FIGS. 5-22 show three preferred embodiments of the present invention, a first embodiment attachable to swing-jib mounting plates 2, a second dielectric insulated embodiment for live electrical line work, and a third embodiment designed for operation without an onboard hydraulic power package or battery power. As a result, it should be appreciated that the preferred embodiments of the present invention disclosed herein are being offered for illustrative purposes only, and the full scope of the present invention should be determined by the appended claims and their legal equivalents, rather than being limited to the examples given.

Figure 2:
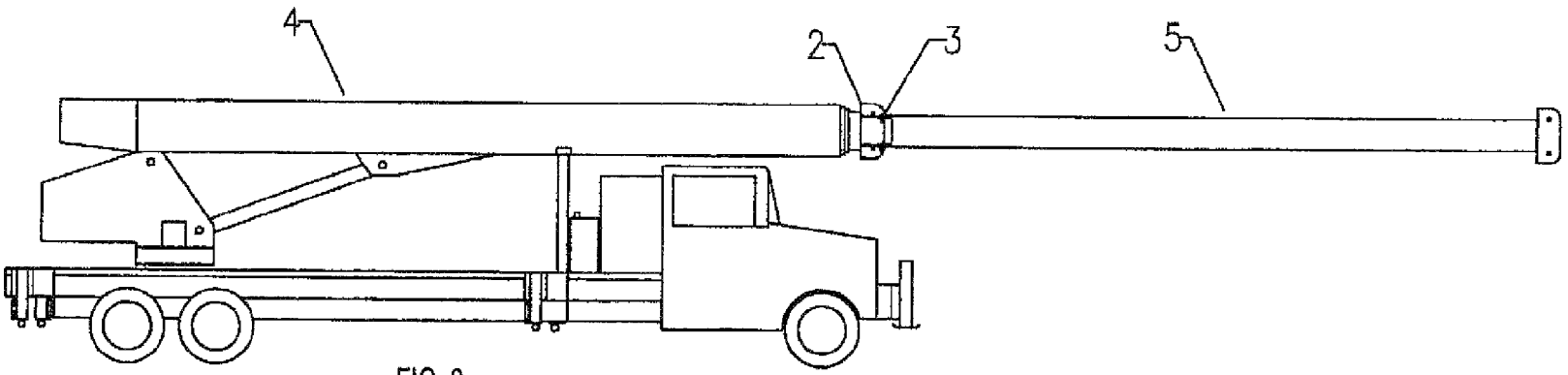
FIG. 2 PRIOR ART
FIG. 2 is a side elevation view of the prior art mobile crane truck shown in FIG. 1, with its prior art swing-jib boom removed from its road-travel-ready stowed position and now attached to swing-jib sheave head mounting plates on the crane boom tip via multiple swing-jib mounting pins.
Figures 3A, 3B:
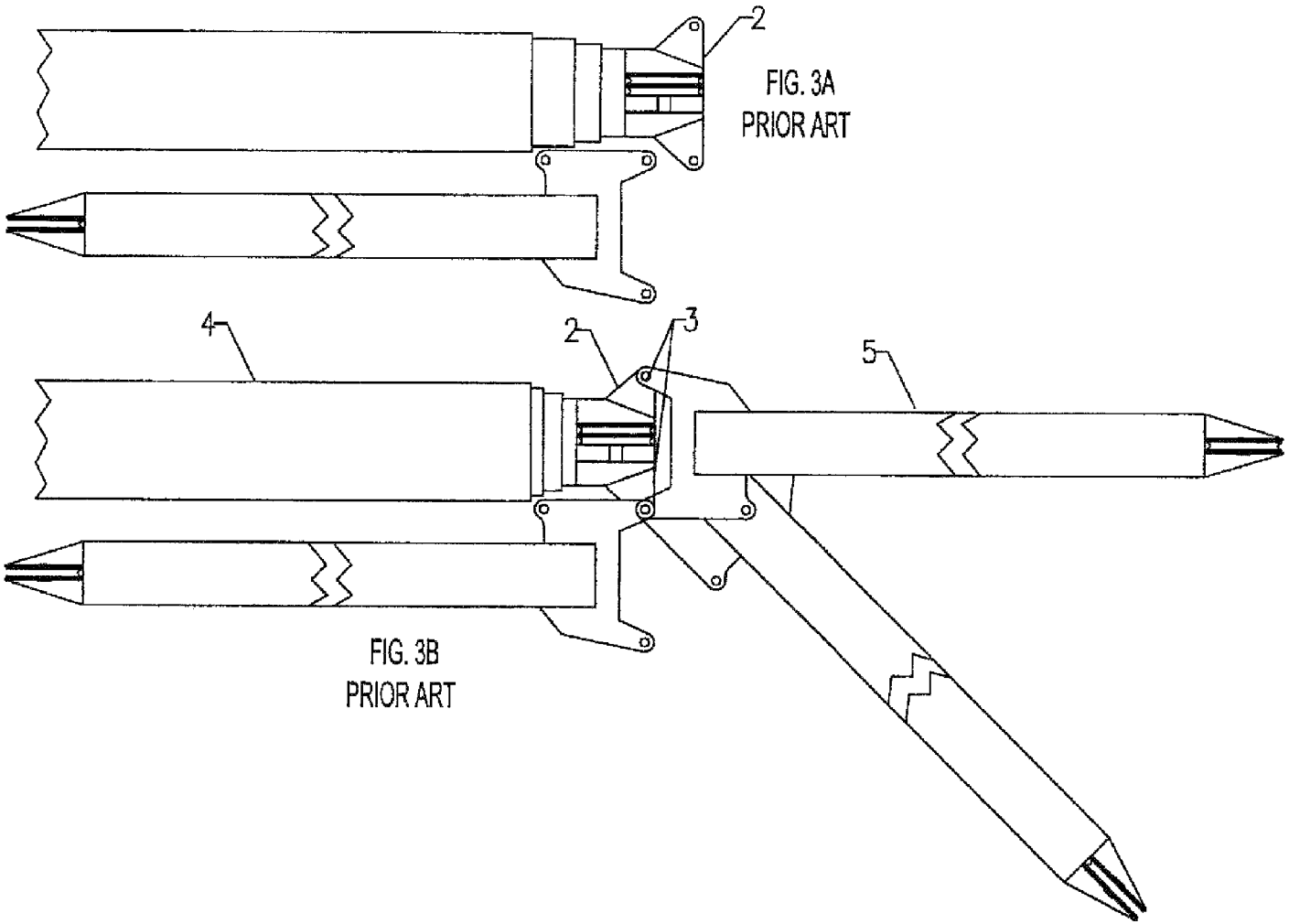
FIG. 3A PRIOR ART
FIG. 3B PRIOR ART
FIG. 3A is a top view of the prior art swing-jib boom shown in FIGS. 1 and 2 after the crane and jib booms are initially deployed and two of the holes in the swing-jib sheave head mounting plates on the crane boom tip are poised to line up with holes in steel plates on the swing-jib boom while it remains supported on the stowage brackets attached to crane's main outer boom and not yet connected to the main crane boom or in a usable position.
FIG. 3B is a top view of the swing-jib shown in FIG. 3A in three successive positions as it is rotated manually 180-degrees about a first pair of swing jib mounting pins acting as a hinge point after being secured in aligned holes in the mounting plates attached to the main crane boom and the swing jib boom, until the swing jib boom is fully rotated to cause alignment of the second set of holes in the mounting plates in the mounting plates attached to the main crane boom and the swing jib boom, and a second pair of mounting pins are secured therein to make a finished connection between the swing jib boom and main crane boom.
Figures 4A, 4B:
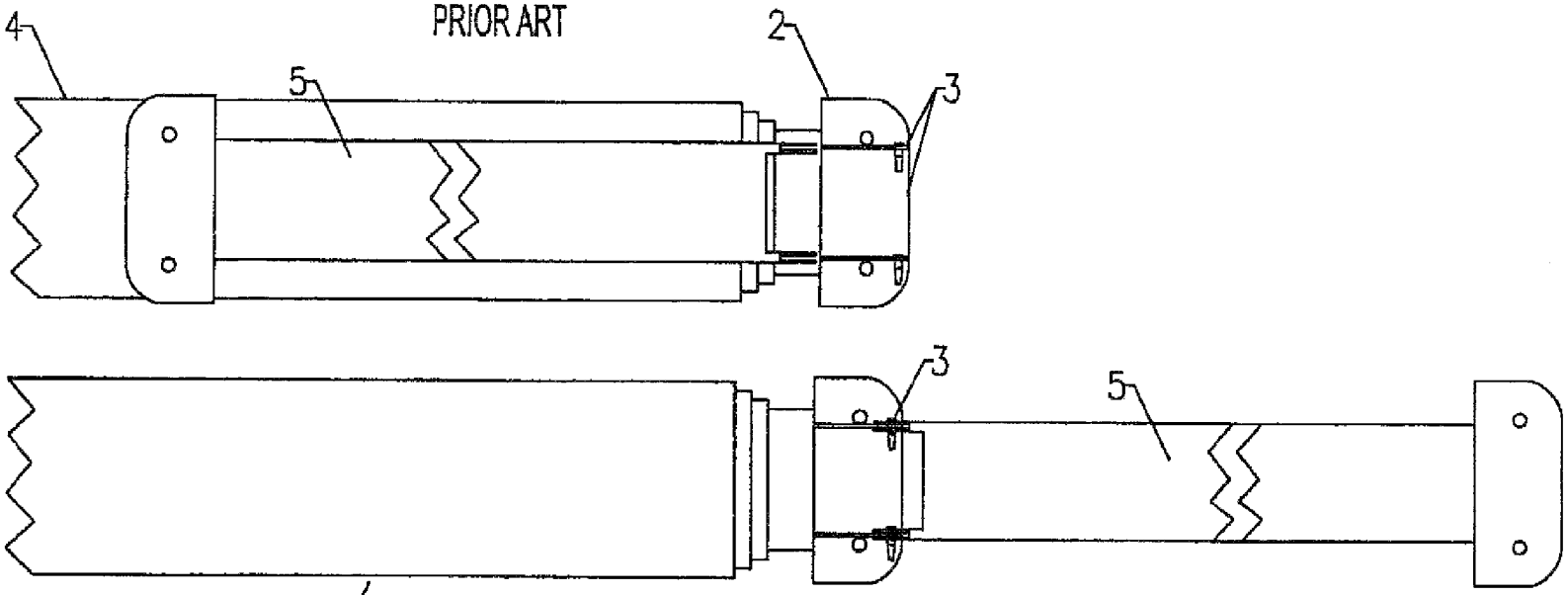
FIG. 4A PRIOR ART
FIG. 4B PRIOR ART
FIG. 4A is a side elevation view of a first brand-dedicated prior art swing-jib boom commonly found on cranes boom trucks and in its road-travel-ready stowed position where it is disconnected from the crane boom, disabled, and unusable, with this brand-dedicated prior art jib boom not designed with variable rotation or an articulating work range, instead having one working position and that is straight in-line off the crane boom tip.
FIG. 4B is a side elevation view of the prior art swing-jib boom shown in FIG. 4A after its attachment to the crane boom in its only working position-of-use straight off the crane boom tip and in-line with it, and further without any design capability for variable rotation or articulating work range, instead only having the one working position in-line with the crane boom and straight off the crane boom tip.

FIGS. 1-4 show several views of a prior art manually-installed swing-jib boom 5 for comparison to the jib boom attachment 1 of the present invention, with FIGS. 1 and 2 both showing a mobile telescopic boom crane unit with its main boon crane 4 extending in a horizontal road-travel-ready orientation above a supporting truck bed and also in part above the truck's cab. FIG. 1 is a side elevation view showing a swing-jib boom 5 also in a horizontally-extending orientation positioned above the truck bed and cab alongside the fully-operational main crane boom 4. Swing-jib boom 5 is stowed and secured on two spaced-apart stowage brackets 15 depending outwardly from the side of main crane boom 4. In contrast, FIG. 2 is a side elevation view showing the swing-jib boom 5 attached to the distal end of crane boom 4 via swing-jib sheave head mounting plates 2 and swing-jib mounting pins 3, with swing-jib boom 5 extending forwardly beyond the front end of the truck supporting crane boom 4. In contrast, FIGS. 3A, 3B, 4A, and 4B show enlarged views of the connection made between the prior art swing-jib boom 5 and main crane boom 4. FIGS. 1, 2, 3A, 3B, 4A, and 4B all show main boom crane 4 having the mounting plates 2 of a swing-jib sheave head secured to tip of its distal end, the same mounting plates 2 used to support the present invention jib boom attachment 1 (see FIG. 5 for one illustration thereof). The swing-jib boom 5 shown in a stowed position in FIG. 1 is disconnected from main crane boom 4 for road travel, while in FIGS. 2, 3B, and 4B the swing-jib boom 5 is not in a road-ready travel position and instead is secured to the swing-jib sheave head's mounting plates 2 using as many as four mounting pins 3 provided by the manufacturer of swing-jib boom 5 (with four mounting pins 3 providing a full connection between swing-jib boom 5 and main crane boom 4). In the respective top and side views of FIGS. 3A and 4A, swing-jib boom 5 is located near mounting plates 2 and poised for connection to them using four mounting pins 3, while in the respective top and side views of FIGS. 3B and 4B the swing-jib boom 5 is connected to mounting plates 2 using four mounting pins 3. FIG. 3B further shows the connection of swing-jib boom 5 to only one side of mounting plates 2, with the partial connection to mounting plates 2 functioning as a hinge point while swing-jib boom 5 is rotated 180-degrees thereabout for alignment with, and full connection to, the mounting plates 2 on the swing-jib sheave head secured to the distal end of main crane boom 4. The prior art mobile telescopic boom crane unit shown in FIGS. 1 and 2 is a fully designed and engineered machine capable of lifting, telescopic motion, and rotating large loads within a work area determined by a load chart and work range chart. Note that in FIG. 1 the swing-jib sheave head mounting plates 2 and swing-jib mounting pins 3 are shown idle and have nothing attached to them, the condition needed before the present invention jib boom attachment 1 can be connected to main crane boom 4. However, the prior art swing-jib boom 5 shown in FIG. 1 alongside main crane boom 4 must be removed from the stowage brackets 15 depending outwardly from the side of main crane boom 4 before connection of the present invention's jib boom attachment 1 could be made to the mounting plates 2 of the swing-jib sheave head secured to the distal end of main crane boom 4.

FIGS. 3A, 3B, 4A and 4B show the fixed position of a manually-attached prior art swing-jib boom 5 that is considered as patentably distinct from the present invention jib boom attachment 1. This prior art fixed jib boom 5 design has an important negative flaw, which requires attachment and detachment of swing-jib boom 5 with respect to main crane boom 4 according to the three progressive steps illustrated in FIG. 3B every time the equipment is moved to a new work site. For installation of swing-jib boom 5, crane boom 4 must first be positioned over the side of its supporting truck and lowered to allow removal of mounting pins 3 from one side of the mounting plates 2 and reinsertion therein to provide a hinge point between swing-jib boom 5 and main crane boom 4. Then, main crane boom 4 must be raised level to the ground and, using a rope tied to its distal end, the swing-jib boom 5 is manually rotated 180-degrees into the position needed for its full connection to main crane boom 4. Main crane boom 4 is then lowered to the ground again and the final mounting pins 3 are inserted into the two reaming attachment holes in the swing-jib sheave head mounting plates 2 to transfer torsion and bending moments applied to swing-jib boom 5 to the swing-jib sheave head on the distal end of main crane 4. In addition, after detachment from main crane boom 4, time must be taken to secure prior art swing-jib boom 5 to the side of main crane boom 4 prior to road travel. Another limiting disadvantage of this prior art is that swing-jib boom 5 has only one work position, which is straight out from the tip/end of main crane boom 4, which allows it to be used for lifting. However, swing-jib boom 5 does not rotate or articulate once it is secured into its usable work position to move around encountered obstacles (not shown), as does the present invention jib boom attachment 1.

Figure 5:
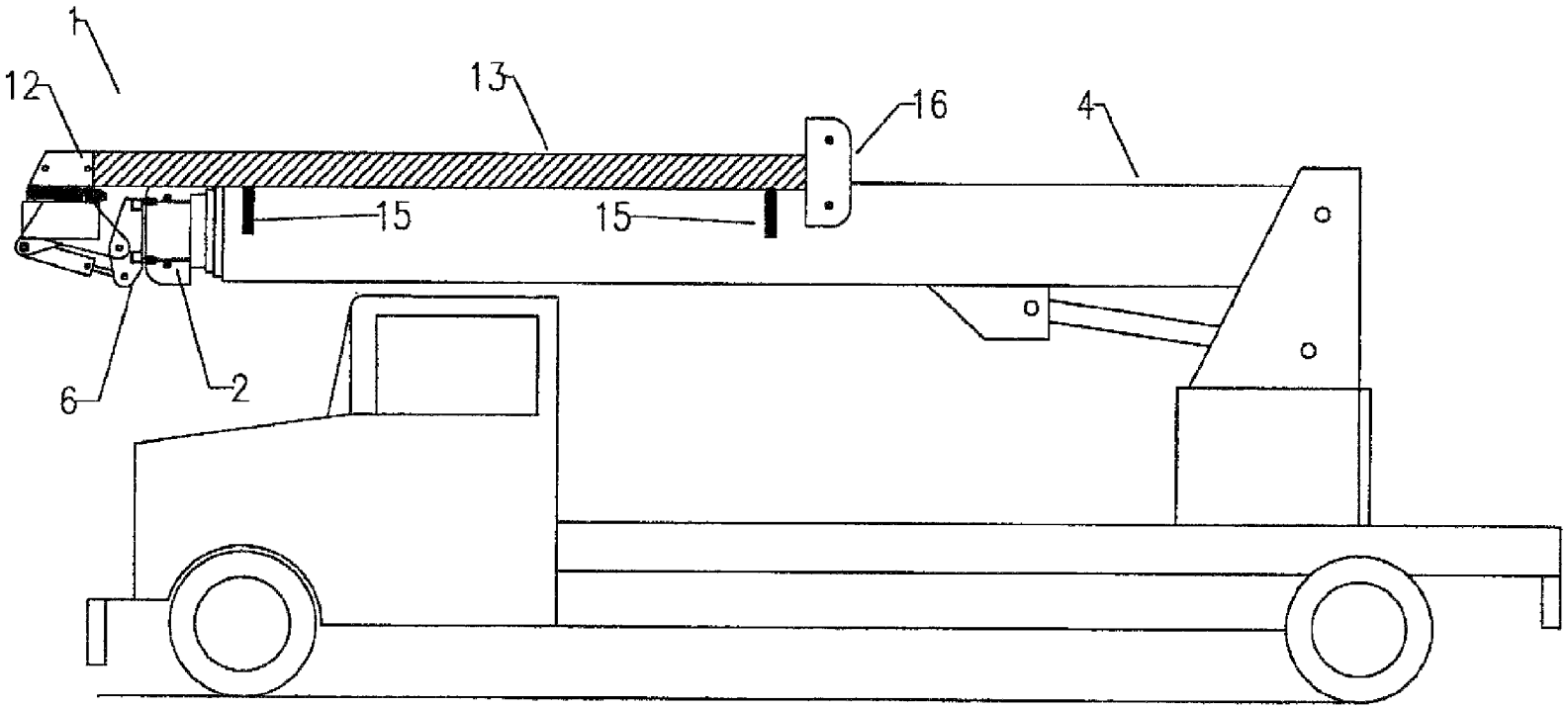
FIG. 5 is a side elevation view of the most preferred embodiment of present invention swing-jib boom attached to a fully-operational mobile telescopic boom crane truck that is a fully designed and engineered machine capable of lifting, telescopic motion, and rotation of large loads within a work area determined by a load chart and work range chart, and since the present invention swing-jib boom has no attached work platform, it is in a preferred road-travel-ready stowed position that allows it to remain fully attached to the sheave head on the crane boom tip while within the legal envelope for road-ready travel and cradled on stowage brackets depending outwardly from the exterior surface of the crane truck's outermost boom tube, however in this fully attached condition the linear leveling actuator, jib boom rotation base, and jib boom support structure necessarily become situated in front of the truck's cab in positions clearing the driver's vision.
Figure 6:
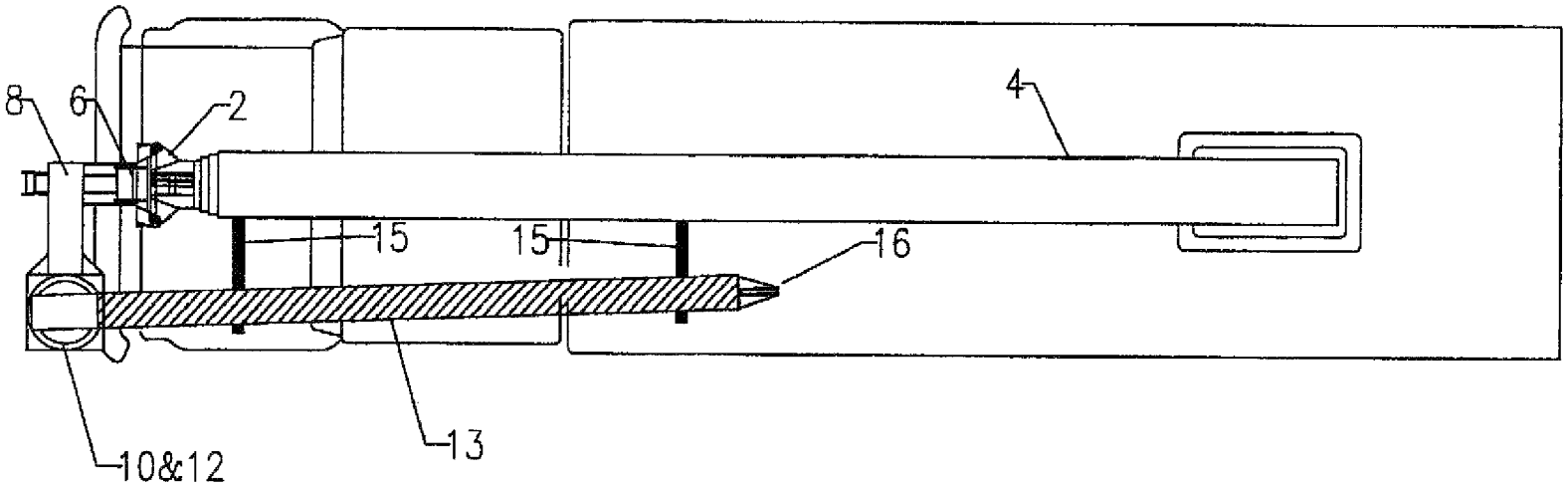
FIG. 6 is a top view of the most preferred embodiment of present invention swing-jib boom attached to the fully-operational mobile telescopic boom crane truck shown in FIG. 5 that is a fully designed and engineered machine capable of lifting, telescopic motion, and rotation of large loads within a work area determined by a load chart and work range chart, with the swing-jib boom cradled on stowage brackets secured to the side of the truck's main crane boom in a road-travel-ready stowed position while it remains attached to the sheave head on the crane boom tip.

FIGS. 5 and 6 respectively show the most preferred embodiment of the self-contained present invention jib boom attachment 1 that is self-leveling during articulation in a vertical plane of 90-degrees and also has a 360-degree rotation range in a horizontal plane regardless of the angle of main crane boom 4, allowing jib boom attachment 1 to move around objects and obstacles (not shown) encountered in elevated work areas. In FIGS. 5 and 6, jib boom attachment 1 without an attached work platform is secured to a mobile main crane boom 4 having a longitudinal orientation relative to its supporting truck and a substantially horizontally-extending orientation relative to the ground surface (not given a numerical designation) under the truck, with main crane boom 4 and jib boom attachment 1 both positioned within the legal height and width envelope required for road-ready travel (as best shown by the top view in FIG. 6). FIGS. 5 and 6 are respectively side elevation and top views showing jib boom attachment 1 secured to the swing-jib sheave head mounting plates 2 on the distal end of main crane boom 4 via four swing-jib mounting pins 3 (that are identified numerically in the enlarged views of the same structure provided by FIGS. 10 and 11). Also in FIGS. 5 and 6, jib boom attachment 1 is rotated outboard and substantially parallel to main crane boom 4, and shown in its stowed and road-travel-ready position upon two spaced-apart stowage brackets 15. The compact overall height of jib boom attachment 1, and the use of a substantially planar jib boom mounting bracket 6 and a low-profile jib boom rotation base 8 as part of the connection for work platform attachment 1 to main crane boom 4, allows jib boom attachment 1 to stow alongside main crane boom 4, not higher or lower than main crane boom 4, while the top of jib boom attachment 1 remains below the road-legal height requirement of 13-feet-and-6-inches. Once the jib boom mounting bracket 6 is attached to the swing jib mounting plates 2 on the sheave head tip of main crane boom 4 with the mounting pins 3 provided by the swing-jib boom 5 manufacturer, the connection between jib boom attachment 1 and main crane boom 4 provides a solid base anchor that can handle the rotational, torsional, and bending moments induced as jib boom tube 13 and/or the optionally attached work platform 14 are loaded, stationary, leveling through its articulation range, and/or rotated through its 360-degree horizontal rotation range. As main crane boom 4 is articulated up or down, the present invention jib boom tube 13 and optional work platform 14 are kept level by means of a linear leveling actuator 7 connected between jib boom mounting bracket 6 and jib boom rotation base 8, which vertically pushes or pulls jib boom rotation base 8 a needed amount relative to pivot pin 9. Linear leveling actuator 7 preferably has a safety locking mechanism to hold linear position in place should a hose or wire fail during the leveling operation. Although not limited thereto, linear leveling actuator 7 preferably has either a hydraulic cylinder or an electric rotary-screw actuator, and a 5-inch hydraulic cylinder may be used as a part thereof. Movement of the 360-degree rotation bearing drive assembly 10 and the hydraulic cylinder of linear leveling actuator 7 is precisely controlled using the self-contained electronic-hydraulic systems (including its auxiliary power unit 24 and battery-powered power package 23) of jib boom attachment 1, even when the maximum rated load is attached to the end of jib boom tube 13. Auxiliary power unit 24 and battery-powered power package 23 typically incorporate off-the-shelf commercially available components, such as but not limited to deep-cycle large-amp-hour marine batteries, a DC motor, gear pump, fluid reservoir, and proportional electric/hydraulic controlled solenoid valves 18. Although not shown in FIG. 5 or 6, onboard self-contained power for operation of the present invention jib boom attachment 1 may be directed to an electronic control box on work attachment 14 having hand-operated electric joy sticks and switches (or other means conventional to aerial lift boom trucks) that control auto-leveling, leveling over-ride, and jib boom tube 13 rotation, in addition to an on/off switch (which can be a foot-actuated on/off switch) used to provide manual leveling adjustment for work platform 14 as needed to maintain a level orientation even during unanticipated changes in payload/personnel balance or movement. In addition, to meet aerial lift safety codes the present invention jib boom attachment 1 incorporates a redundant ground-operated remote radio-operated control system 21 (shown in part in FIGS. 12 and 23) having the same functions as the control box on work platform 14 to allow personnel on the ground to control the leveling and rotation of work platform 14. Once attached to crane boom 4, jib boom tube 13 and optional work platform 14 can remain on crane boom 4 for road travel, if desired, which provides the important time-saving advantage of allowing an operator to instantly operate jib boom attachment 1 after the supporting mobile crane truck arrives at a new work location and its outriggers are set. An additional option for mobile cranes use of the present invention could be for the jib boom tube 13 and work platform 14 shown in FIGS. 5 and 6 to forego the self-contained onboard auxiliary power unit 24 and battery-powered power package 23 used therewith and shown in FIG. 12, instead obtaining hydraulic or electrical power for jib boom tube 13 and optional work platform 14 via means conventional to aerial boom lift trucks (such as hose/cable reels) directly from the connected mobile crane truck or other equipment positioned at ground level with delivery via the hydraulic control valves 18, wiring 19, and hose carrier tube 17 shown in FIG. 23.

Figure 7A:
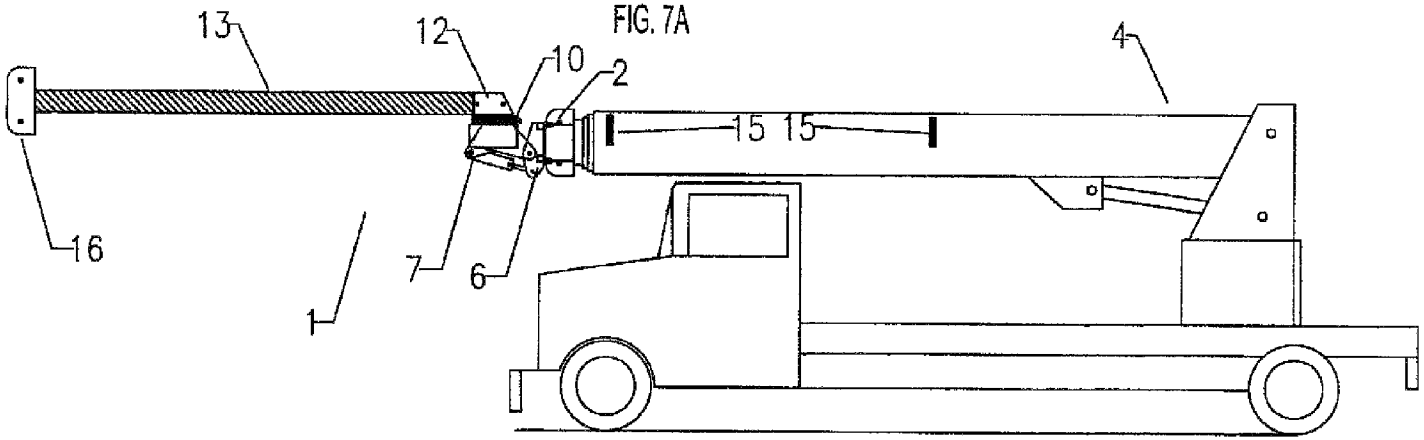
FIG. 7A is a side view of the most preferred embodiment of present invention swing-jib boom and fully-operational mobile telescopic boom crane truck shown in FIGS. 5 and 6, with the swing-jib boom no longer supported by the stowage brackets and instead rotated into a position in front of the truck.
Figure 7B:
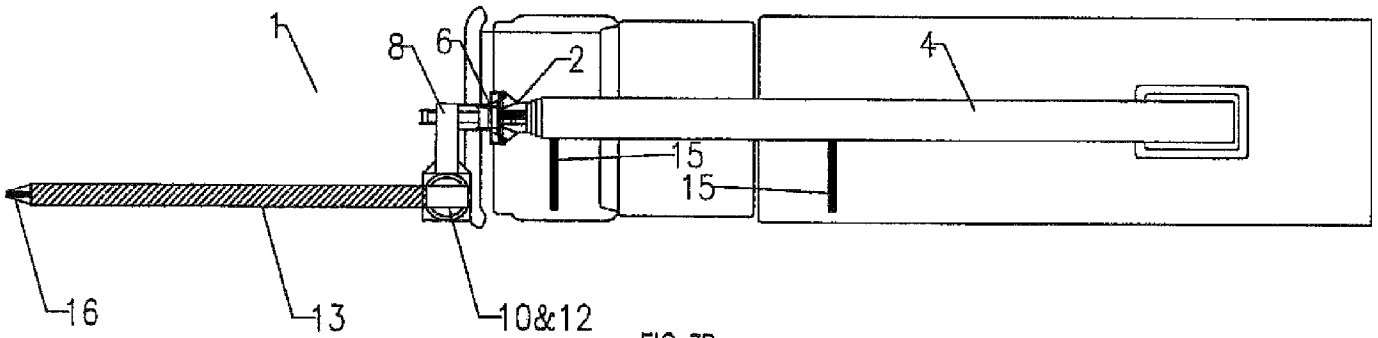
FIG. 7B is a top view of the most preferred embodiment of present invention swing-jib boom and fully-operational mobile telescopic boom crane truck shown in FIG. 7A with the swing-jib boom rotated into a position in front of the truck that is substantially parallel to the main crane boom.
Figure 8:
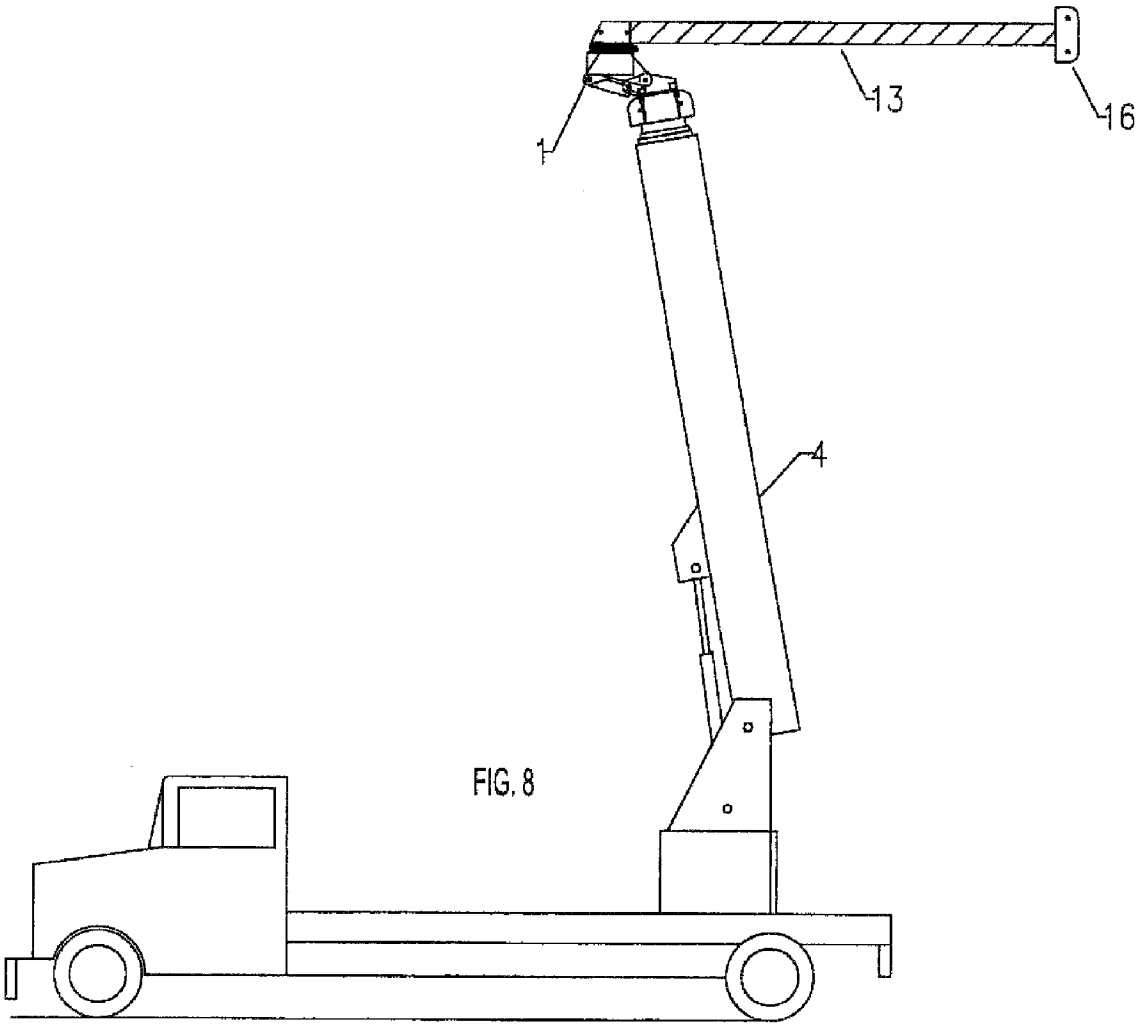
FIG. 8 is a side elevation view of the most preferred embodiment of present invention swing-jib boom and fully-operational mobile telescopic boom crane truck shown in FIGS. 5, 6, 7A, and 7B with the main crane boom articulated upwardly at an approximate 80-degree angle relative to the ground under the truck, the jib boom still positioned level with the ground as a result of its leveling cylinder holding/locking, or continually maintaining a level orientation, for the top of its jib boom rotation base in the level orientation displayed, the jib boom leveling articulation precisely controlled using the electronic hydraulic system and its linear leveling actuator even when the maximum rated load is attached to the end of the present invention jib boom, with the leveling movement created by the jib boom articulating up and down relative to the pivot pin secured to the jib boom mounting bracket.
Figure 9:
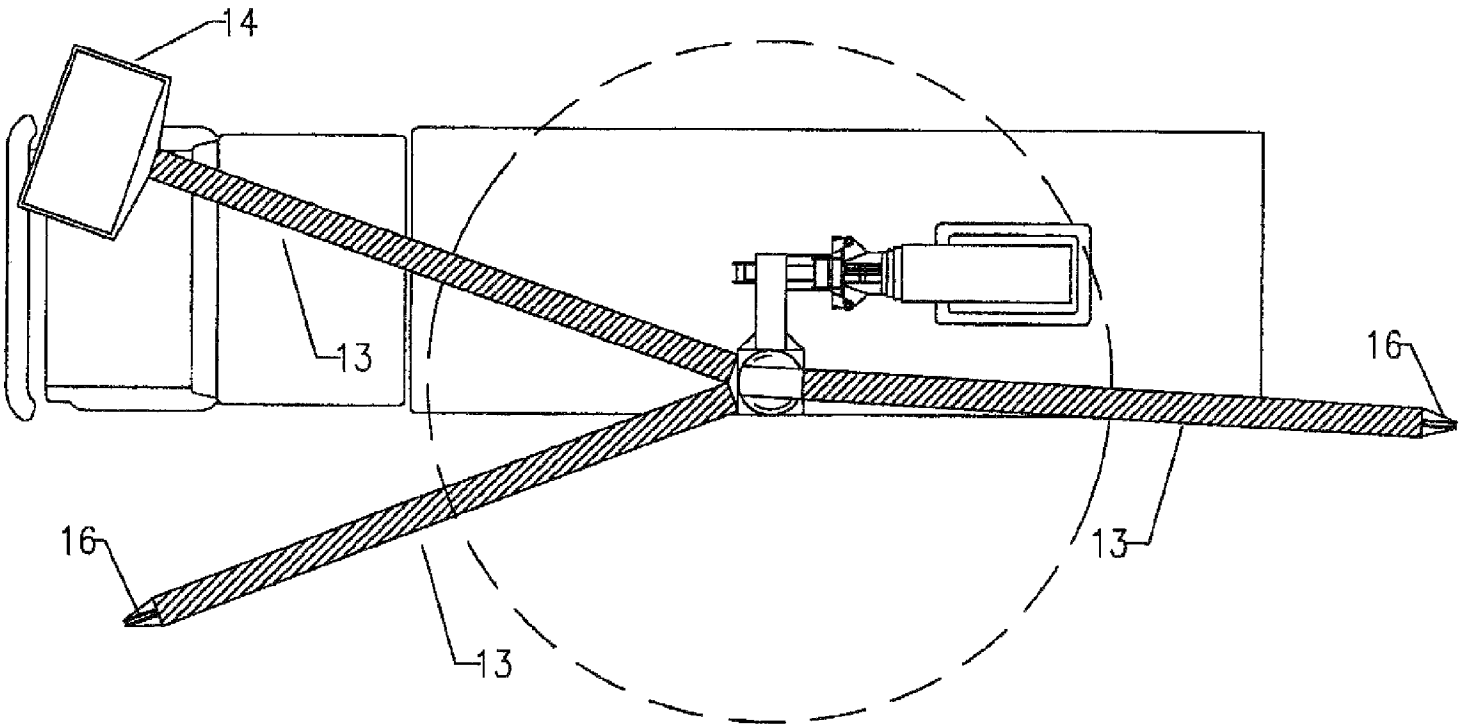
FIG. 9 is a top view of the most preferred embodiment of present invention jib boom demonstrating its ability to rotate 360-degrees in the horizontal plane above the tip of the main crane boom's sheave head, with the rotation preferably implemented by a hydraulic bearing drive assembly configured to allow jib boom rotation through a horizontal range of approximately 360-degrees from its stowed position, with the jib boom rotation precisely controlled using its the electronic-hydraulic systems (including its auxiliary power unit and battery-powered power package) even with the maximum rated load attached to the end of jib boom, with one of the three jib boom positions showing an optional work platform, and the other jib boom positions revealing the jib sheave tip that is preferred for work platform attachment on the present invention jib boom's distal end.

FIGS. 7A, 7B, 8, and 9 show views of jib boom attachment 1 in various configurations of articulation and rotation. FIGS. 7A and 7B respectively are side and top views of the most preferred embodiment of jib boom attachment 1 (without work platform 14) connected to the mounting plates 2 on the sheave head secured to the distal end of the main crane boom 4 of the fully-operational mobile telescopic boom crane truck shown in FIGS. 5 and 6, with the main crane boom still in its stowed road-ready travel position and the swing-jib type boom attachment 1 rotated approximately 180-degrees from its stowed position alongside main crane boom 4 into positioning that places it in front of the supporting mobile telescopic boom crane truck. In contrast, FIG. 8 is a side elevation view of the same jib boom attachment 1 (without work platform 14) previously shown in FIGS. 7A and 7B, and in FIG. 8 jib boom attachment 1 maintains a horizontally-extending orientation. However, in FIG. 8 main crane boom 4 is articulated upwardly at an approximate 80-degree angle relative to the ground under the mobile telescopic boom crane truck and jib boom attachment 1 is rotated 180-degrees from the forwardly-directed position shown in FIGS. 7A and 7B into a rearwardly-directed position causing it to extend beyond the rear end of the mobile telescopic boom crane truck. The jib boom attachment 1 will maintain its level positioning level with the ground as a result of its linear leveling cylinder 7 holding, or continually maintaining, the top of its jib boom rotation base 8 in the level orientation displayed, the articulation of jib boom attachment 1 precisely controlled using the on-board electronic-hydraulic system (includes auxiliary power unit 24 and battery-powered power package 23) even when the maximum rated load is attached to the end of jib boom attachment 1, via vertical leveling articulate movement relative to the pivot pin 9 attached to jib boom mounting bracket 6. FIG. 9 is a top view of the most preferred embodiment of present invention jib boom demonstrating its ability to rotate 360-degrees in the horizontal plane about the sheave head tip of main crane boom 4 hydraulically-powered by rotation bearing drive assembly 10 that allows jib boom attachment 1 with or without work platform 14 to rotate from its stowed position alongside main crane boom 4 on stowage brackets 15 substantially 360-degrees around the sheave head tip of main crane boom 4, with the rotation of jib boom attachment 1 precisely controlled using the present invention onboard electronic-hydraulic system even with the maximum rated load connected to the end of jib boom attachment 1, with one of the three positions for jib boom attachment 1 in FIG. 9 showing optional work platform 14, and the other positions for jib boom attachment 1 revealing the jib sheave tip 16 that is preferred for attachment of work platform 14 on the end jib boom tube 13. Furthermore, rotation of the most preferred embodiment of jib boom attachment 1 can be stopped at any time while moving between the three positions of work platform attachment 1 shown in FIG. 9 by the broken circular line, and locked into a needed position. The approximate 360-degree rotation of the present invention jib boom attachment 1 allows positioning flush, parallel, and perpendicular to any adjacent work surface, as well as adjustment to any angle necessary that allows easy worker access to an elevated job area. Also, its 360-degree rotation allows jib boom attachment 1 to easily move around objects and obstacles encountered in many aerial work sites, often eliminating the need to reposition the supporting vehicle under main crane boom 4 when a work platform 14 is attached to jib boom attachment 1 for improved access of personnel aboard work platform 14 to the elevated work area.

Figure 10:
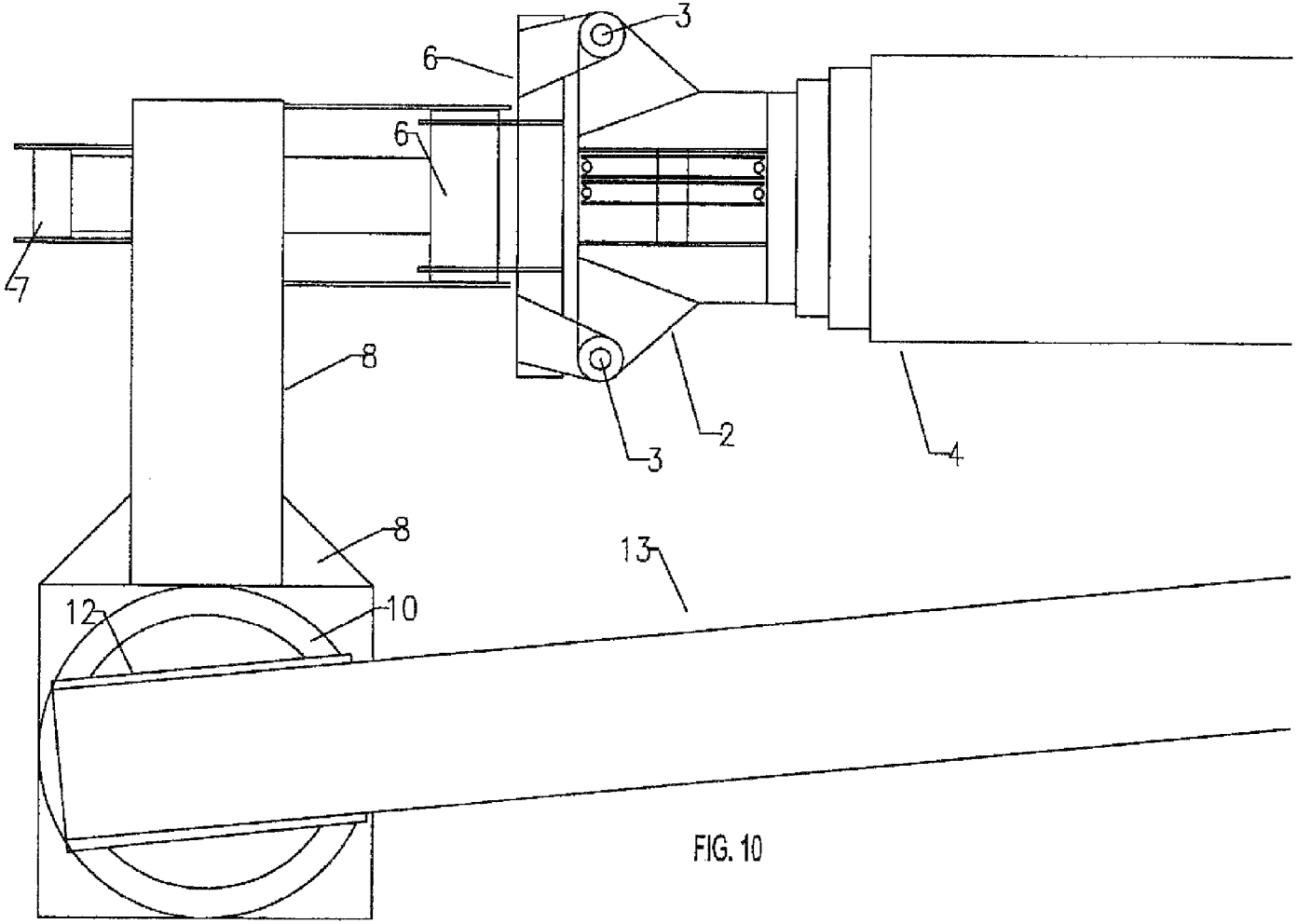
FIG. 10 is an enlarged top view of the sheave head connection between the main crane boom tip and the jib boom in the most preferred embodiment of the present invention shown in FIG. 6, with the jib boom in a road-travel-ready and stowed position along one side of the main crane boom, and also with the jib boom secured to the swing-jig sheave head mounting plates on the crane boom tip via mounting pins obtained from the swing-jib sheave head manufacturer, making it ready for use immediately upon arrival at a next designated work location.
Figure 11:
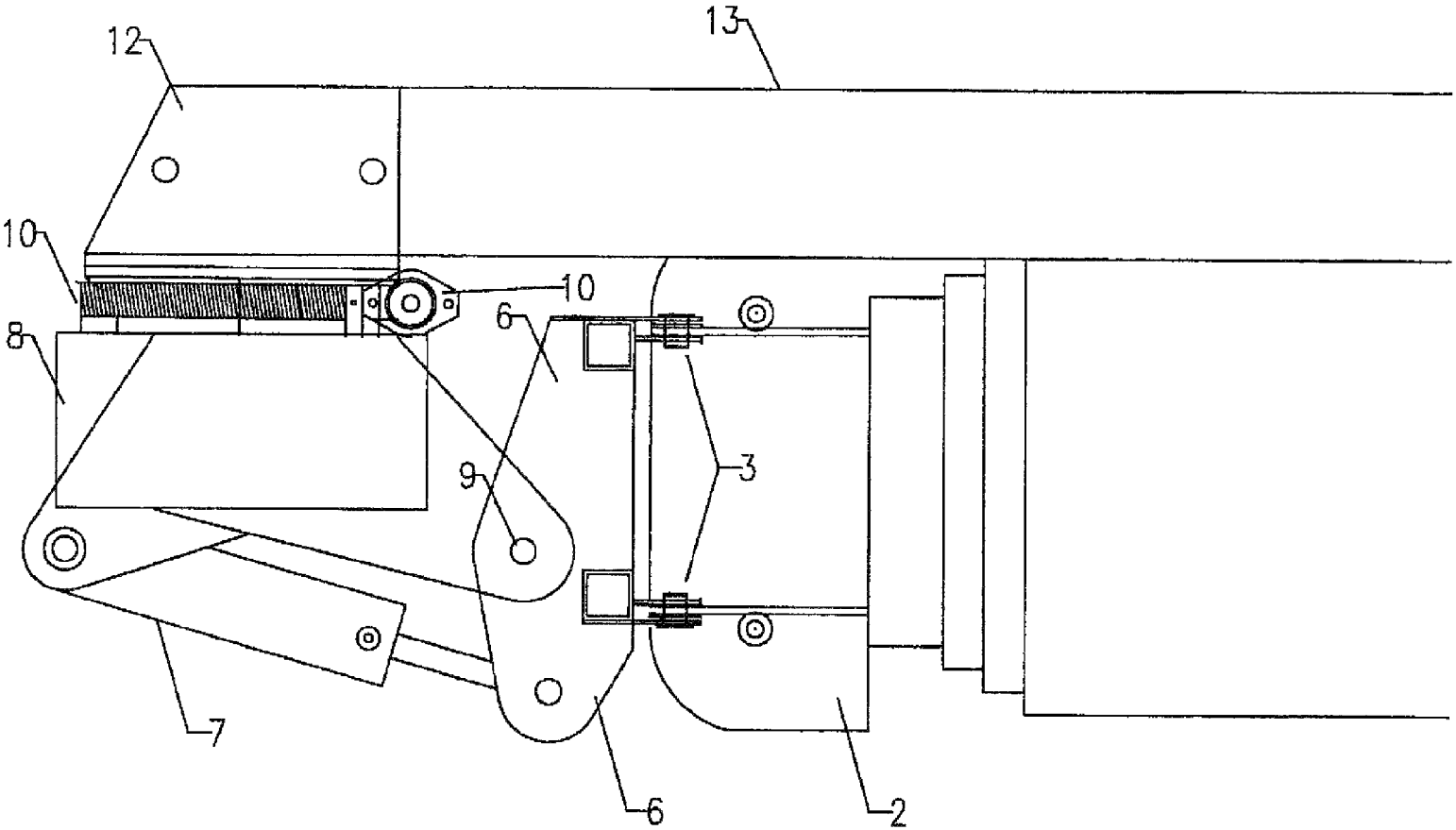
FIG. 11 is an enlarged right side elevation view of the connection between the most preferred embodiment of the self-contained present invention jib boom attachment and the swing-jib sheave head mounting plates on the crane boom tip shown in FIG. 5, the same swing-jib sheave head mounting plates that could be used to connect a work platform directly on the end of the main crane boom, with the present invention jib boom attachment secured to the swing-jig sheave head mounting plates and both in their road-travel-ready stowed positions, the stowed jib boom positioned outboard and substantially parallel to the stowed main crane boom.
Figure 12:
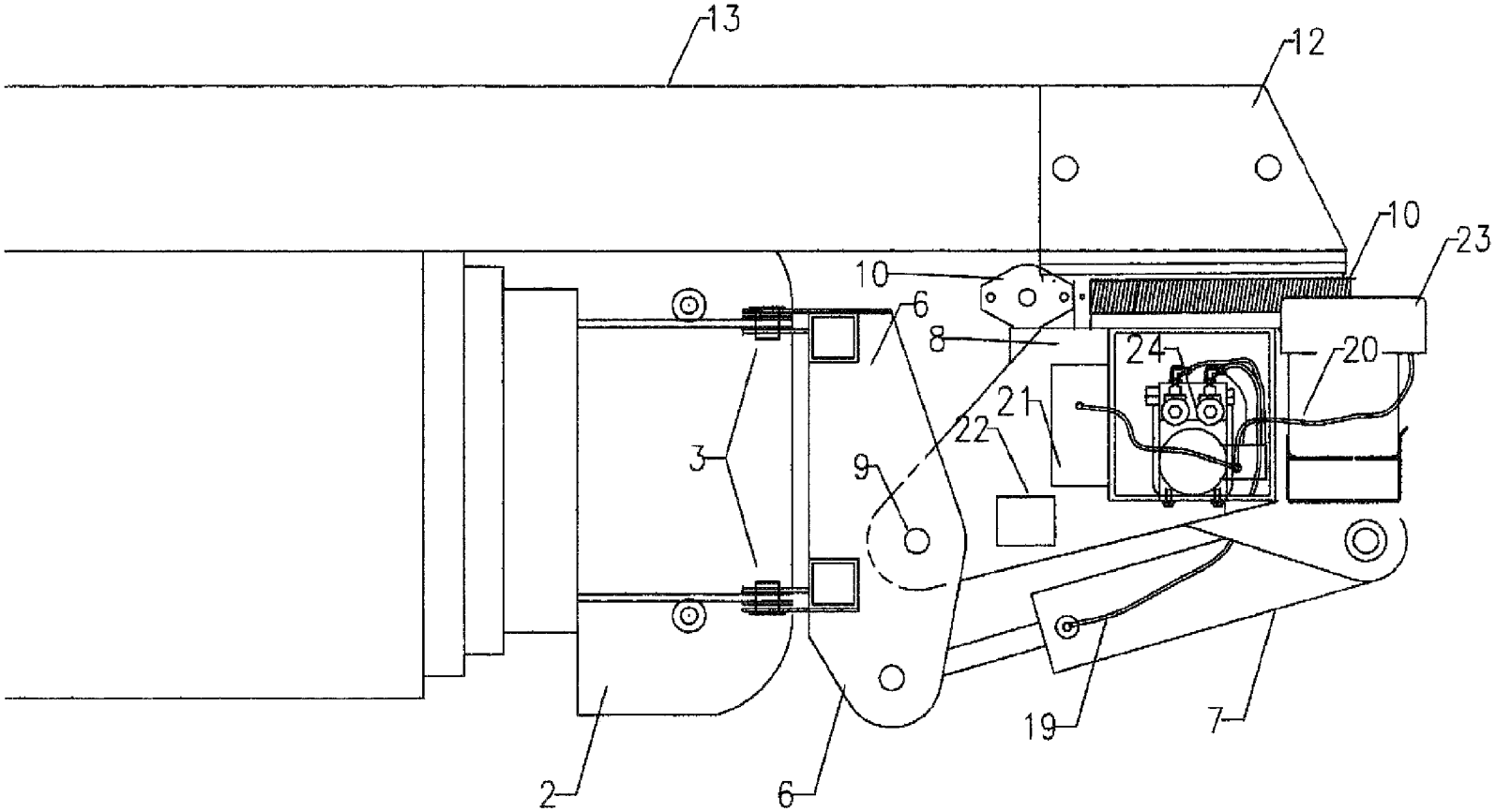
FIG. 12 is a left side elevation view of the self-contained jib boom shown in FIG. 11, with part of the illustration showing connection of the present invention jib boom attachment to the sheave head mounting plates on the main crane boom tip, and the remainder of the illustration showing present invention onboard electronic-hydraulic systems (including its auxiliary power unit and battery-powered power package), linear leveling actuator, jib boom rotation base, rotation bearing drive assembly, and leveling pivot pin, that are used in combination for automated self-leveling of the present invention jib boom attachment with or without work platform during main crane boom articulation and regardless of the articulated angle of the main crane boom, as well as jib boom articulation and rotation above and about the swing-jib sheave head mounting plates on the crane boom tip, with the present invention radio remote control processor and electronic leveling sensor also illustrated.

FIGS. 10-12 show enlarged views of the connection between jib boom attachment 1 and main crane boom 4 previously shown in FIG. 6, with FIG. 10 showing a top view thereof, FIG. 11 showing a right side elevation view, and FIG. 12 showing a left side elevation view. FIG. 10 shows the jib boom mounting bracket 6 of jib boom attachment 1 connected to the swing-jib sheave head mounting plates 2 on the tip of main crane boom 4 via the four swing-jib mounting pins 3 provided by the swing-jib sheave head manufacturer. FIG. 10 also shows the jib boom tube 13 in jib boom attachment 1 in a stowed position alongside main crane boom 4 and substantially parallel to it. In addition, FIG. 10 shows jib boom mounting bracket 6 connected to jib boom rotation base 8 via linear leveling actuator 7, and jib boom rotation base 8 supporting rotation bearing drive assembly 10, which is connected to the jib boom support structure 12 which secures the proximal end of jib boom tube 13. It is contemplated for jib boom mounting bracket 6, jib boom rotation base 8, linear leveling actuator 7, rotation bearing drive assembly 10, jib boom support structure 12, and jib boom tube 13 to be configured for containment within the required legal envelope for road-ready travel while stowed alongside main crane boom 4 and remaining at least partially connected to it for time-saving advantage in travel to new work locations. FIG. 11 is an enlarged right side elevation view of the connection between self-contained jib boom attachment 1 and the swing-jib sheave head mounting plates 2 on the tip of main crane boom 4 previously shown in FIG. 10, with jib boom tube 13 shown substantially parallel to main crane boom 4 and at a slightly higher elevation with respect to main crane boom 4 (but still within the required legal envelope for road-ready travel). In addition to the mounting pins 3 connecting jib boom support structure 6 to the sheave head mounting plates 2 on the tip of main crane boom 4, FIG. 11 also shows linear leveling actuator 7 connected to the lower portion of jib boom support structure 6, and jib boom rotation base 8 connected to both linear leveling actuator 7 and jib boom support structure 6, with the connection between jib boom rotation base 8 and jib boom support structure 6 made via self-leveling pivot pin 9. The hydraulic cylinder in linear leveling actuator 7 extends or retracts when jib boom tube 13 and its attached work platform 14 are out-of-level, pushing or pulling jib boom rotation base 8 and thus causing it vertical articulate relative to pivot pin 9 in an amount as needed to regain the level orientation of jib boom attachment 1 (with or without an attached work platform 14). FIG. 11 further shows rotation bearing drive assembly 10 connected between the top of jib boom rotation base 8 and the bottom of jib boom support structure 12. In contrast, in addition to the present invention components mentioned immediately hereinabove in this paragraph as part of the invention description provided for FIG. 11, FIG. 12 is a left side elevation view of the self-contained jib boom shown in FIG. 11 that also shows self-contained onboard auxiliary power unit 24 and battery-powered power package 23, the wiring 19 connected to linear leveling actuator 7, hoses and cables 20 connected to auxiliary power unit 24 and battery-powered power package 23, electronic leveling sensor 22, and radio remote control system 21 that are used in combination for automated self-leveling of jib boom attachment 1 with or without work platform 14 during main crane boom 4 articulation and regardless of the articulated angle of main crane boom 4, as well as jib boom tube 13 articulation and rotation above and about the tip of main crane boom 4. The auxiliary power unit 24 and battery-powered power package 23 shown in FIG. 12 may comprise off-the-shelf commercially available components, such as deep-cycle large-amp-hour marine batteries, a direct current (DC) motor, a gear pump, a fluid reservoir, and proportional electric/hydraulic solenoid valves 18.

Figure 13:
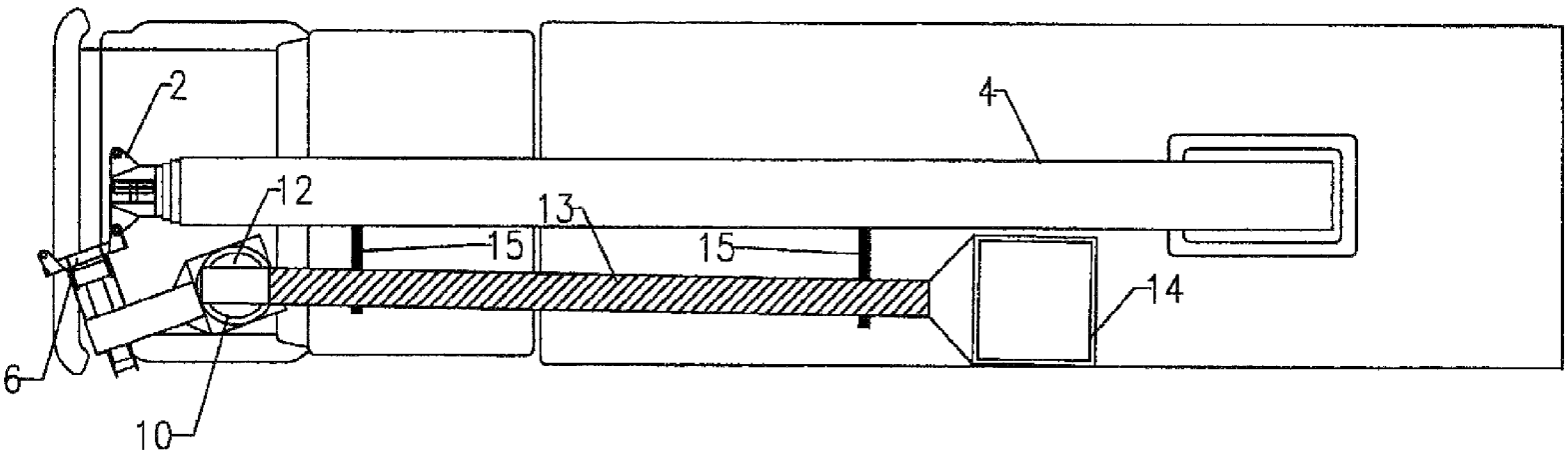
FIG. 13 is a top view of the most preferred embodiment of present invention swing-jib boom with a work platform secured on its distal end to a jib sheave tip, and both the jib boom and its attached work platform in preferred road-travel-ready stowed positions that allow both to remain within the required road-ready travel envelope, however to achieve containment within the required travel envelope the swing-jib boom must remain partially detached from the main crane boom although two mounting pins remain in place to provide a hinge point for rotation of the jib boom back into its fully connected configuration upon arrival at a new work site, the partial disconnection is in contrast to the full connection of the present invention jib boom without a work platform attachment shown in FIG. 5, the jib boom in FIG. 13 is further shown cradled on stowage brackets secured to the exterior surface of a main crane boom of the fully-operational mobile telescopic boom crane truck, substantially parallel to the main crane boom, and its partially disconnected configuration allowing only a small portion of the jib boom attachment assembly to extend forwardly beyond the truck's cab.
Figure 14:
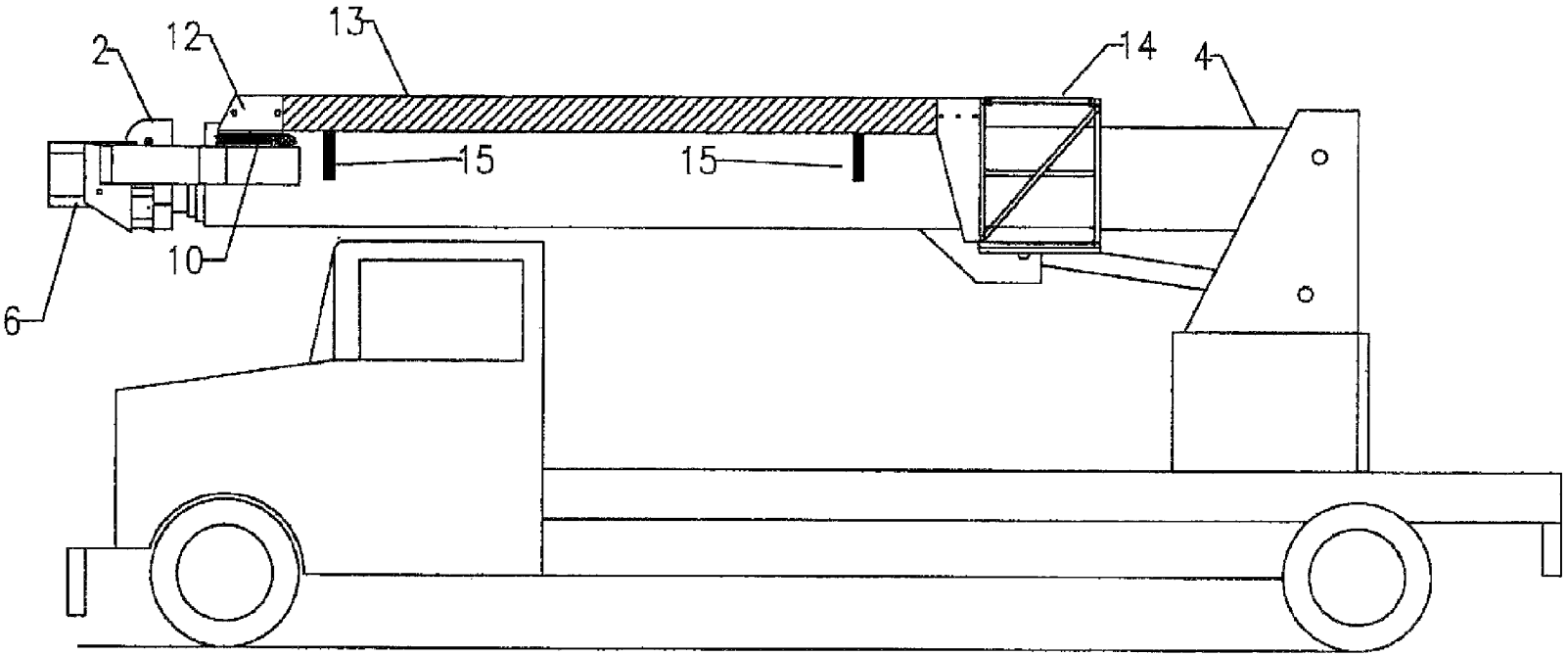
FIG. 14 is a side view of the jib boom with an attached work platform shown in FIG. 13 that is cradled on spaced-apart stowage brackets secured to the exterior surface of the main crane boom.
Figure 15:
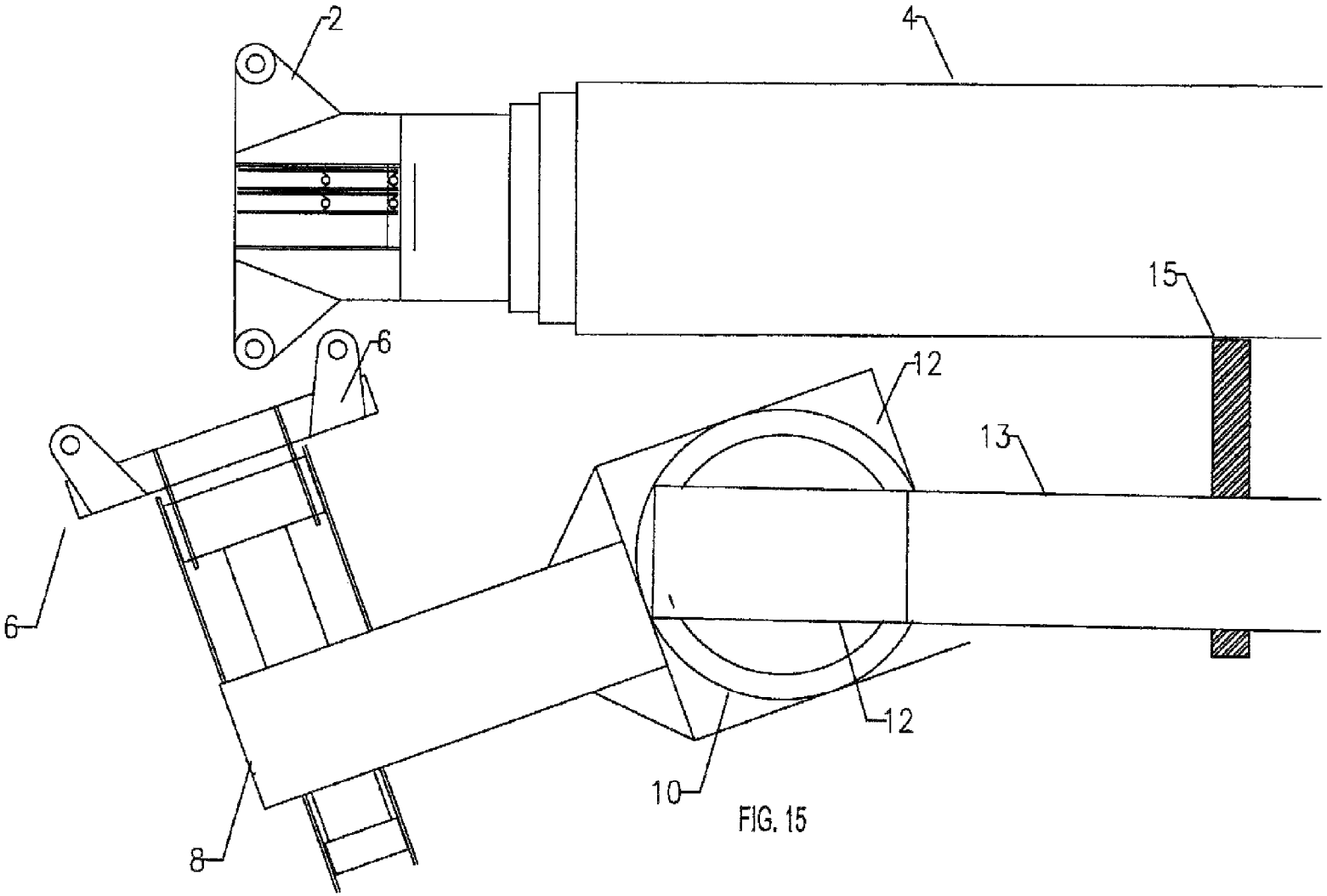
FIG. 15 is an enlarged top view of the present invention jib boom and a main crane boom each appearing to be in stowed positions similar to that shown in FIG. 13, however, all mounting pins have been removed and the holes in the jib boom mounting bracket no longer are aligned with the holes in the mounting plates of the main crane boom sheave head, however the present invention jib boom remains substantially parallel to the main crane boom and cradled on stowage brackets secured to its exterior surface.
Figure 16:
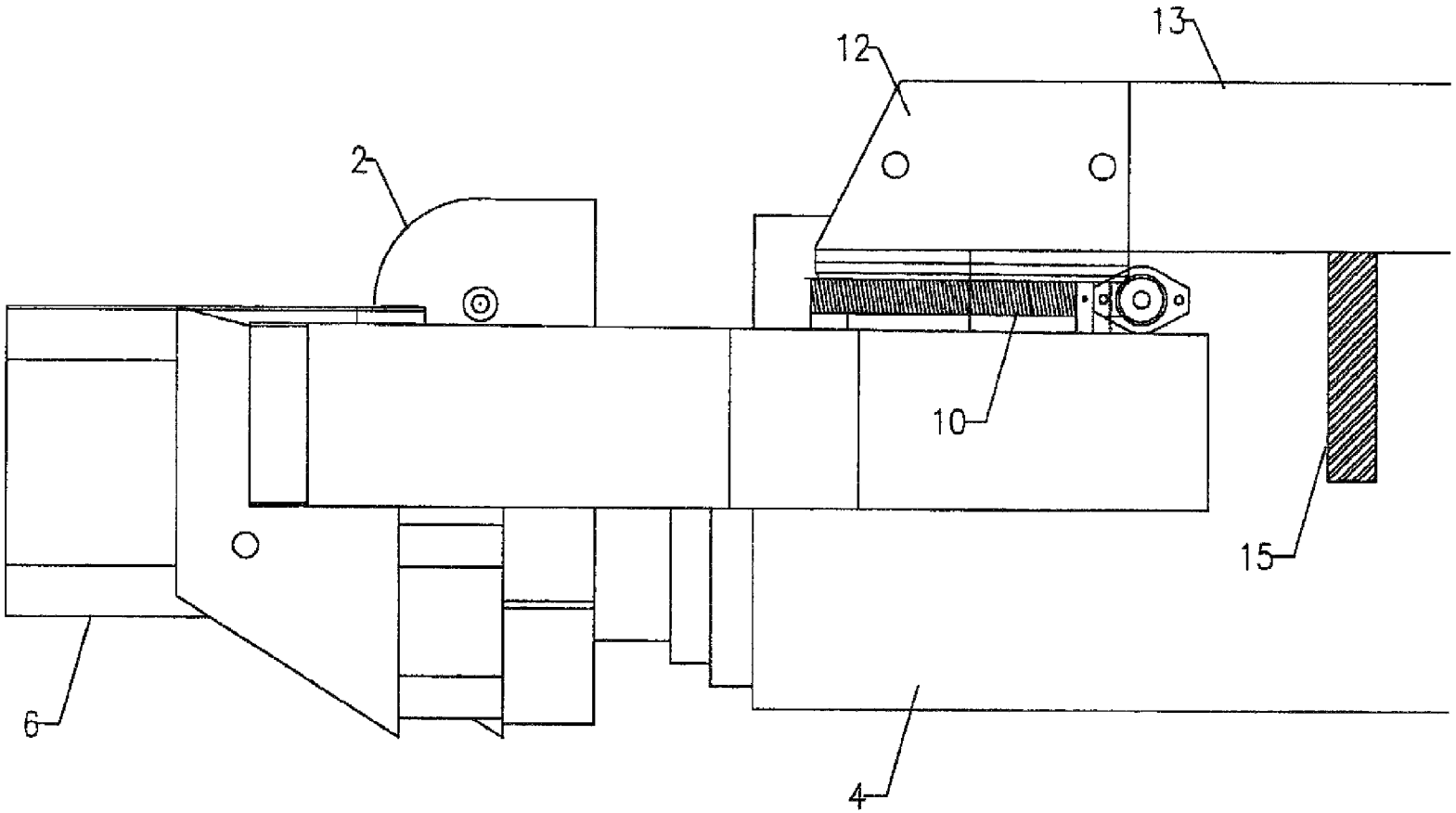
FIG. 16 is an enlarged side view of the present invention jib boom and the main crane boom shown in FIG. 15.
Figure 17A:
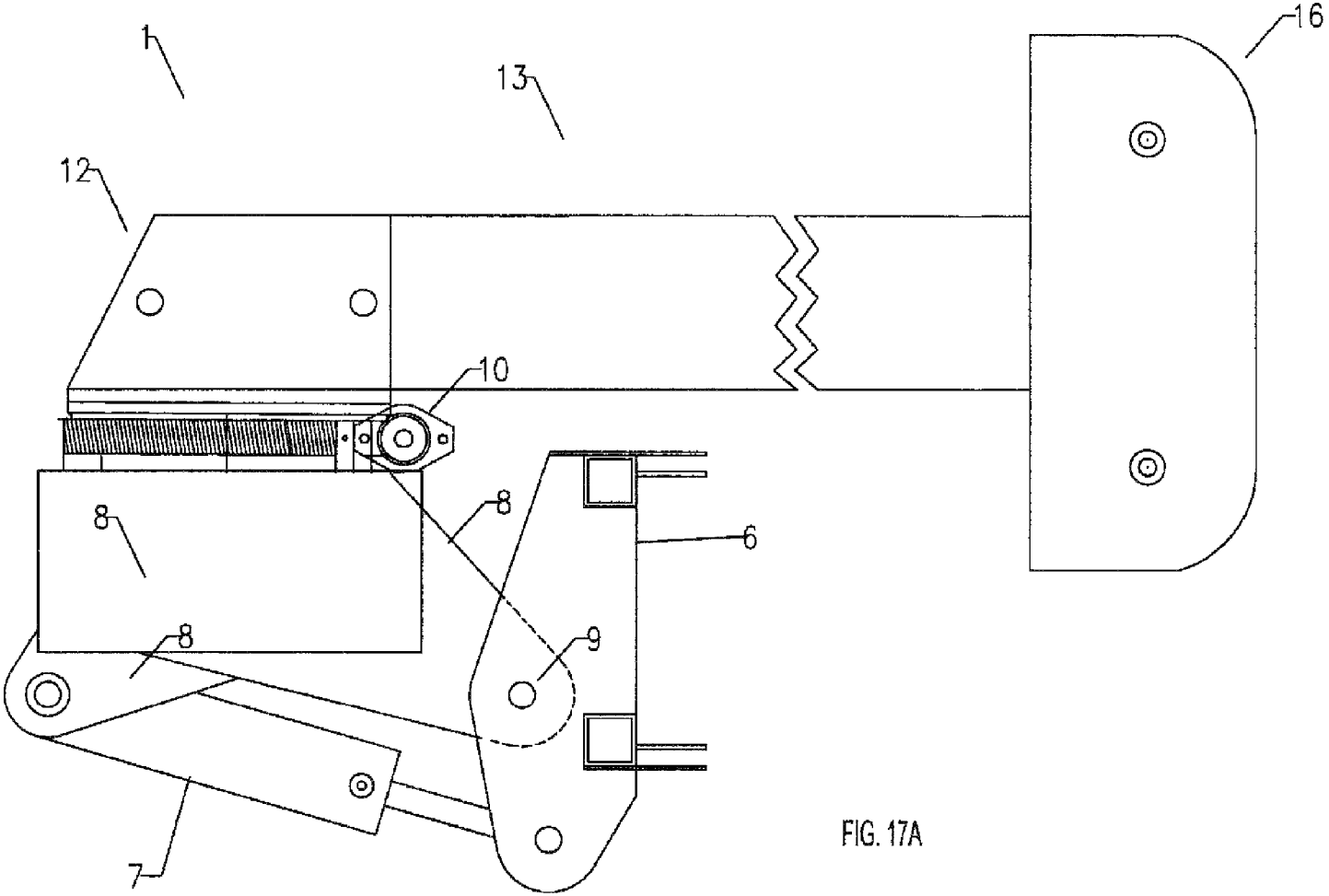
FIG. 17A is a side elevation view of the most preferred embodiment of the self-contained and self-leveling present invention jib boom attachment, and showing its jib sheave tip, jib boom tube, jib boom support structure, rotation bearing drive assembly, jib boom rotation base, linear leveling actuator, self-leveling pivot pin, and jib boom mounting bracket.
Figure 17B:
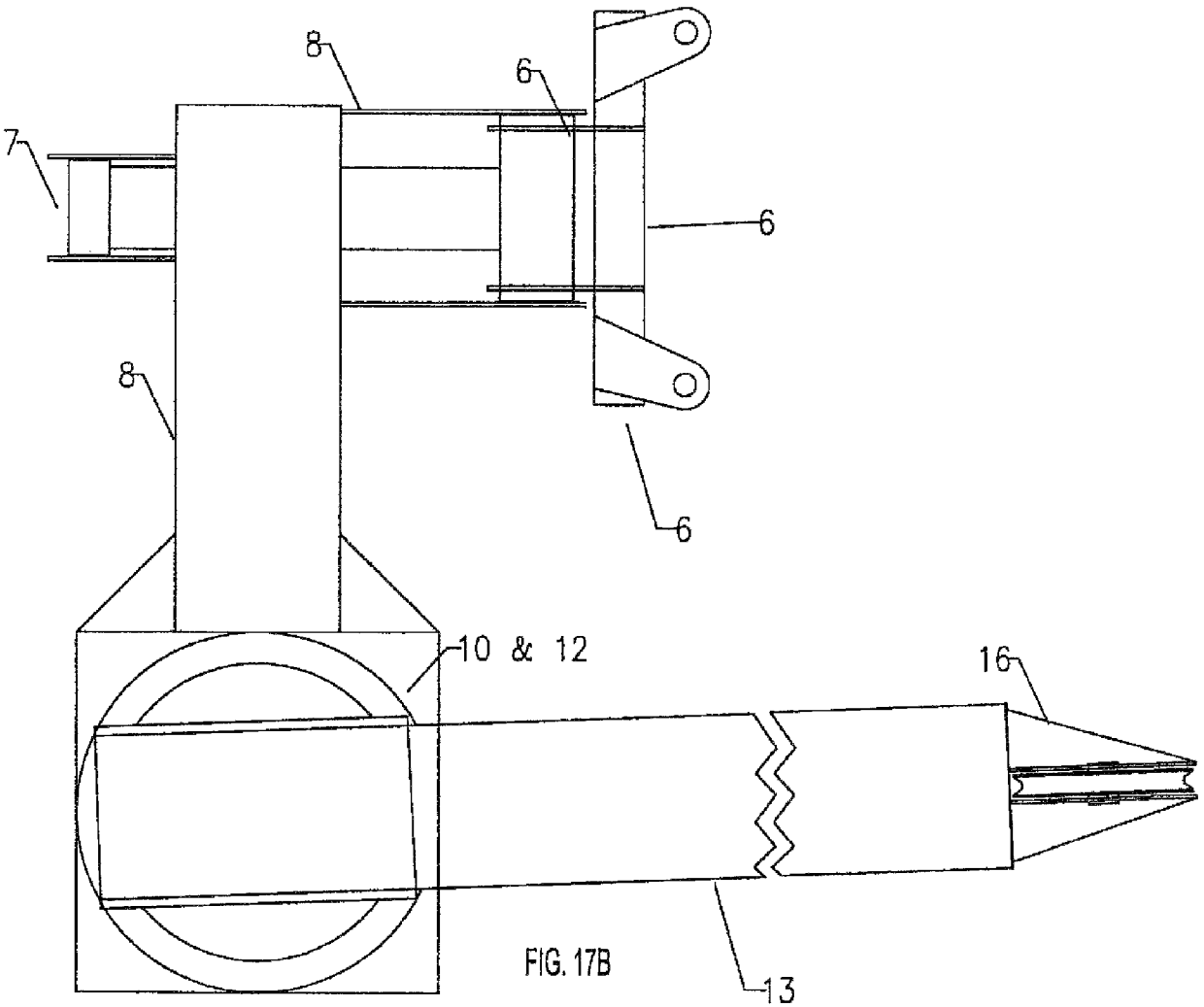
FIG. 17B is a top view of the most preferred embodiment of the self-contained present invention jib boom attachment shown in FIG. 17A.
Figure 18A:
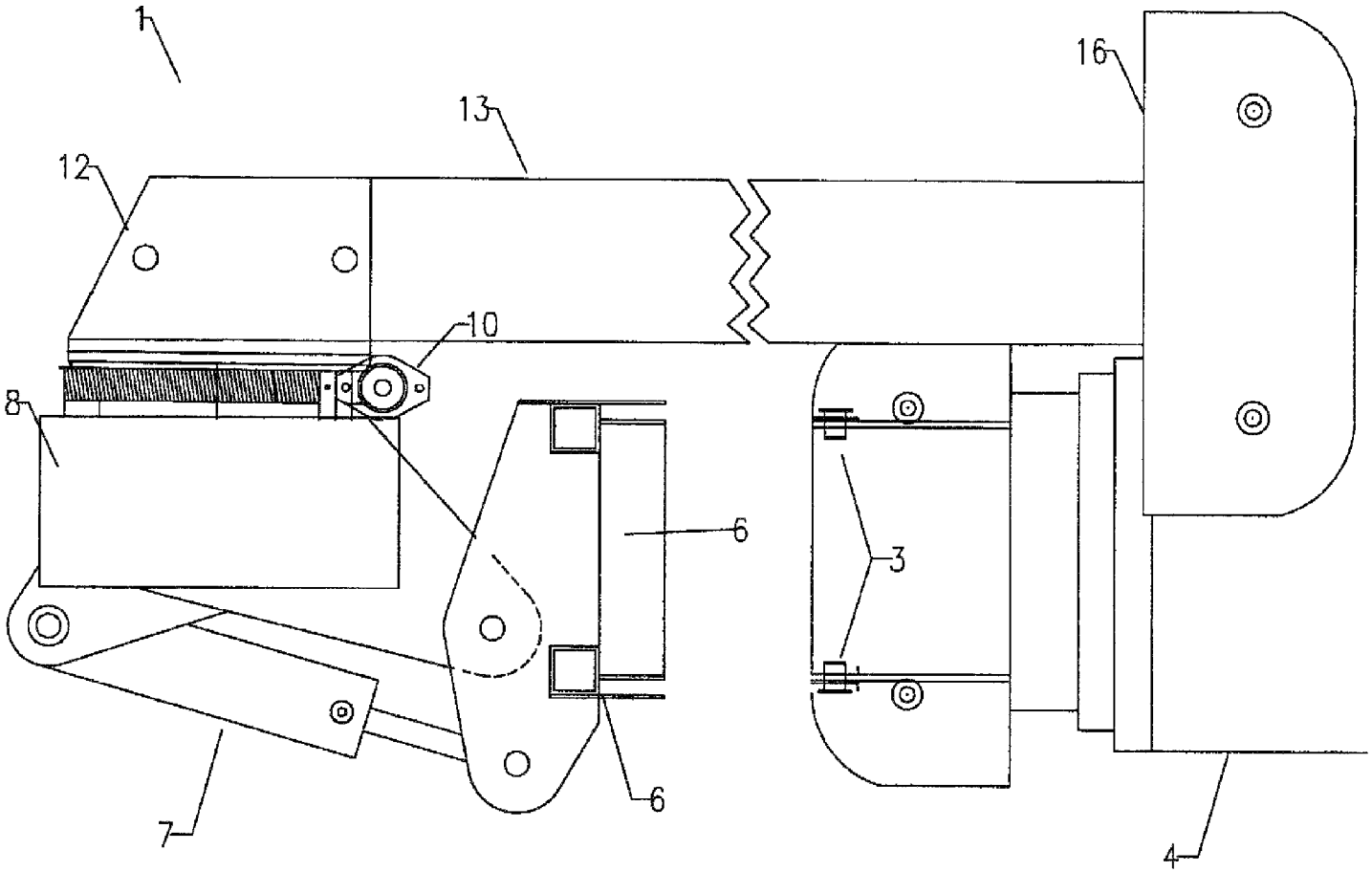
FIG. 18A is a side elevation view of the most preferred embodiment of the self-contained present invention jib boom attachment shown in FIG. 17A with the mounting plates on a main crane sheave head tip aligned with, and in close proximity to, the jib boom mounting bracket of the present invention jib boom attachment.
Figure 18B:
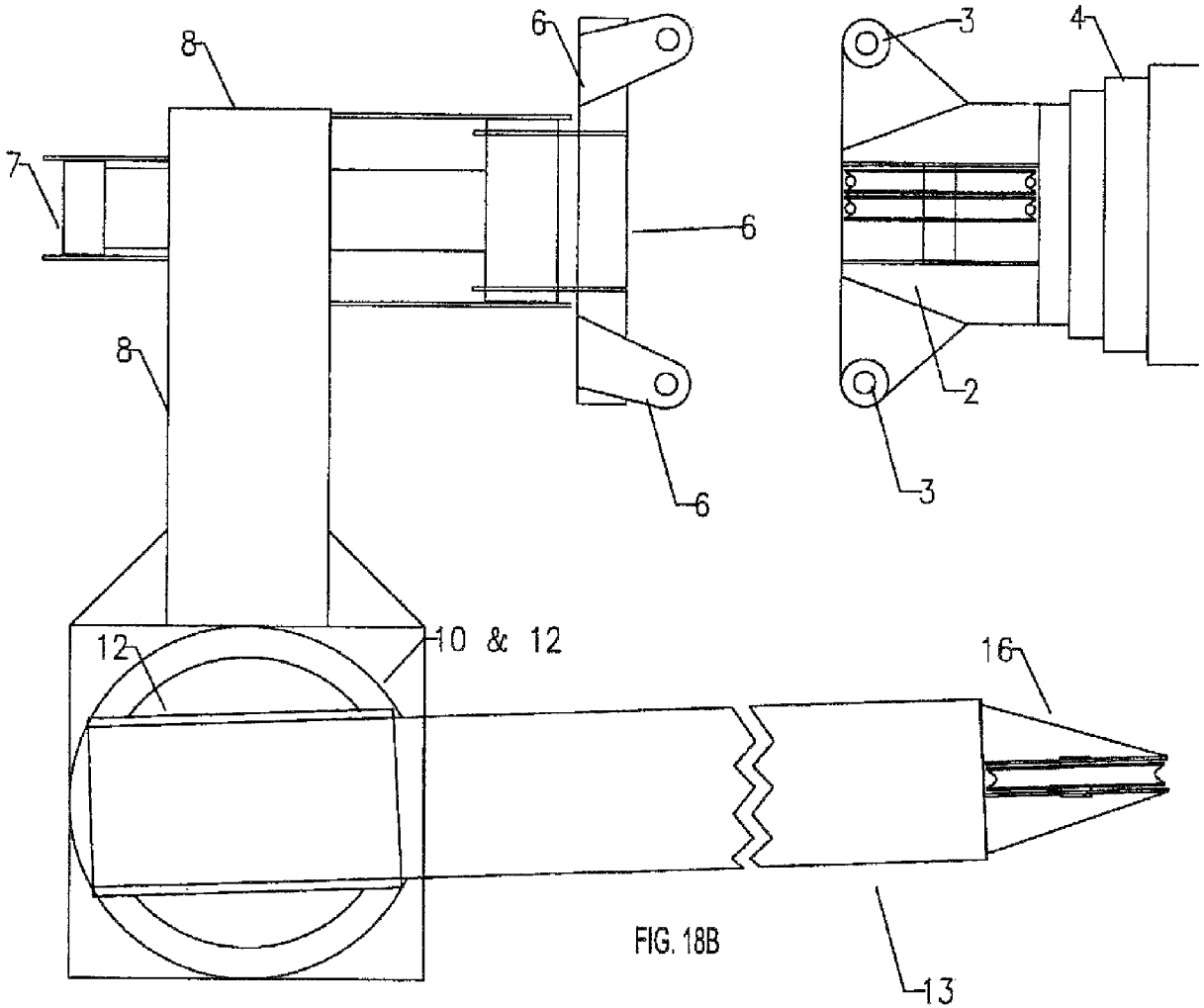
FIG. 18B is a top view of the present invention jib boom attachment and main crane sheave head tip with mounting plates previously shown in FIG. 18A.

FIGS. 13 and 14 jib boom attachment 1 having and work platform 14 in road-legal-ready travel positions relative to a mobile crane truck supporting a main crane boom 4, while FIGS. 15, 16, 17A, 17B, 18A, and 18B show enlarged views of contemplated positioning for jib boom attachment 1 relative to main crane boom 4, and FIGS. 17A and 17B show enlarged views of jib boom attachment 1. FIG. 13 is a top view and FIG. 14 is a side view which show positioning of components in jib boom assembly 1 when a partial connection is present between the jib boom mounting bracket 6 secured to jib boom assembly 1 (with work platform attachment 14) and the sheave head mounting plates 2 secured to the tip of main crane boom 4 which allows jib boom assembly 1, work platform attachment 14, and main crane boom 4 each in its stowed road-travel-ready position to be within the legal envelope required for road travel. FIGS. 13 and 14 show jib boom tube 13 supported alongside main crane boom 4 on stowage brackets 15 and also positioned outboard and substantially parallel to main crane boom 4. FIGS. 13 and 14 also show work platform alongside main crane boom 4 and substantially at the same elevation as main crane boom 4, with jib boom mounting bracket 6 having a similar elevation as the lower half of work platform 14. FIGS. 13 and 14 further identify rotation bearing drive assembly 10 and jib boom support structure 12 as part of the connection between jib boom tube 13 and main crane boom 4. Also, in FIGS. 13 and 14, little of jib boom assembly 1 is shown with forward positioning beyond the front end of the mobile crane truck supporting main crane boom 4. In contrast, FIGS. 15 and 16 respectively show enlarged top and side views of jib boom tube 13 and main crane boom 4 in their stowed positions, with jib boom tube 13 supported by stowage bracket 15. As visible in FIG. 15, jib boom mounting bracket 6 is not connected at all to the sheave head mounting plates 2 on the tip of main crane boom 4, but remains close to mounting plates 2 for fast and easy connection thereto using mounting pins 3. Also shown in FIG. 15, jib boom rotation base 8 and jib boom mounting brackets 6 in FIGS. 15 and 16 have positioning generally parallel to one another and also parallel to main crane boom 4, while in FIGS. 17A, 17B, 18A, and 18B (as best shown in FIGS. 17B and 18B) jib boom rotation base 8 and jib boom mounting brackets 6 still have positioning generally parallel to one another, but are generally perpendicular in orientation to that of main crane boom 4, and as further shown in FIGS. 18A and 18B, the positioning in FIGS. 17A, 17B, 18A, and 18B is needed for full connection of jib boom mounting bracket 6 to the sheave head mounting plates 2 on the tip of main crane boom 4. FIGS. 17A and 17B are respectively side elevation and views of the most preferred embodiment of the self-contained and self-leveling present invention jib boom attachment 1, which shows jib sheave tip 16, jib boom tube 13, jib boom support structure 12, rotation bearing drive assembly 10, jib boom rotation base 8, linear leveling actuator 7, self-leveling pivot pin 9, and jib boom mounting bracket 6. FIGS. 18A and 18B are respectively side elevation and top views of the most preferred embodiment of the self-contained present invention jib boom attachment 1 shown in FIGS. 17A and 17B showing the same invention components, jib sheave tip 16, jib boom tube 13, jib boom support structure 12, rotation bearing drive assembly 10, jib boom rotation base 8, linear leveling actuator 7, self-leveling pivot pin 9, and jib boom mounting bracket 6. However, FIGS. 18A and 18B also illustrate main crane boom 4 and the jib boom mounting bracket 6 of jib boom attachment 1 aligned for connection to the mounting plates 2 on the sheave head tip of main crane boom 4. Furthermore, in FIGS. 18A and 18B the jib boom mounting bracket 6, bottom jib boom rotation base 8, the rotation bearing drive assembly 10 are connected together using pivot pins 9 (see pivot pin 9 marked with numerical designation in FIG. 17A). Rotation bearing drive assembly 10 is the swivel joint that allows jib boom tube 13 to rotate through a maximum of approximately 360-degrees while jib boom mounting bracket 6, linear leveling actuator 7, and bottom jib boom rotation base 8 all stay in fixed attachment to the mounting plates 2 on the swing-jib sheave head on the tip of main crane boom 4. In addition, the bottom of jib boom rotation base 8 is connected to the inside race of rotation bearing drive assembly 10, while jib boom top support structure 12 is attached to the outer race of rotation bearing drive assembly 10, allowing the outer race of rotation bearing drive assembly 10 and all connected components (jib boom support structure 12 and jib boom tube 13) to rotate 360-degrees around the inner race. Thus, rotation bearing drive assembly 10 transfers all of the bending and torsion loads from jib boom attachment 13 through the bottom jib boom rotation base 8, hinge/pivot pin 9, and platform mounting member 6 to the swing-jib sheave head mounting plates 2 on main crane boom 4. Although not limited thereto, rotation bearing drive assembly 10 preferably comprises a slewing ring bearing and an integral hydraulic self-locking worm gear drive mechanism that forces jib boom support structure 12 to rotate a full 360-degree.

Figure 22:
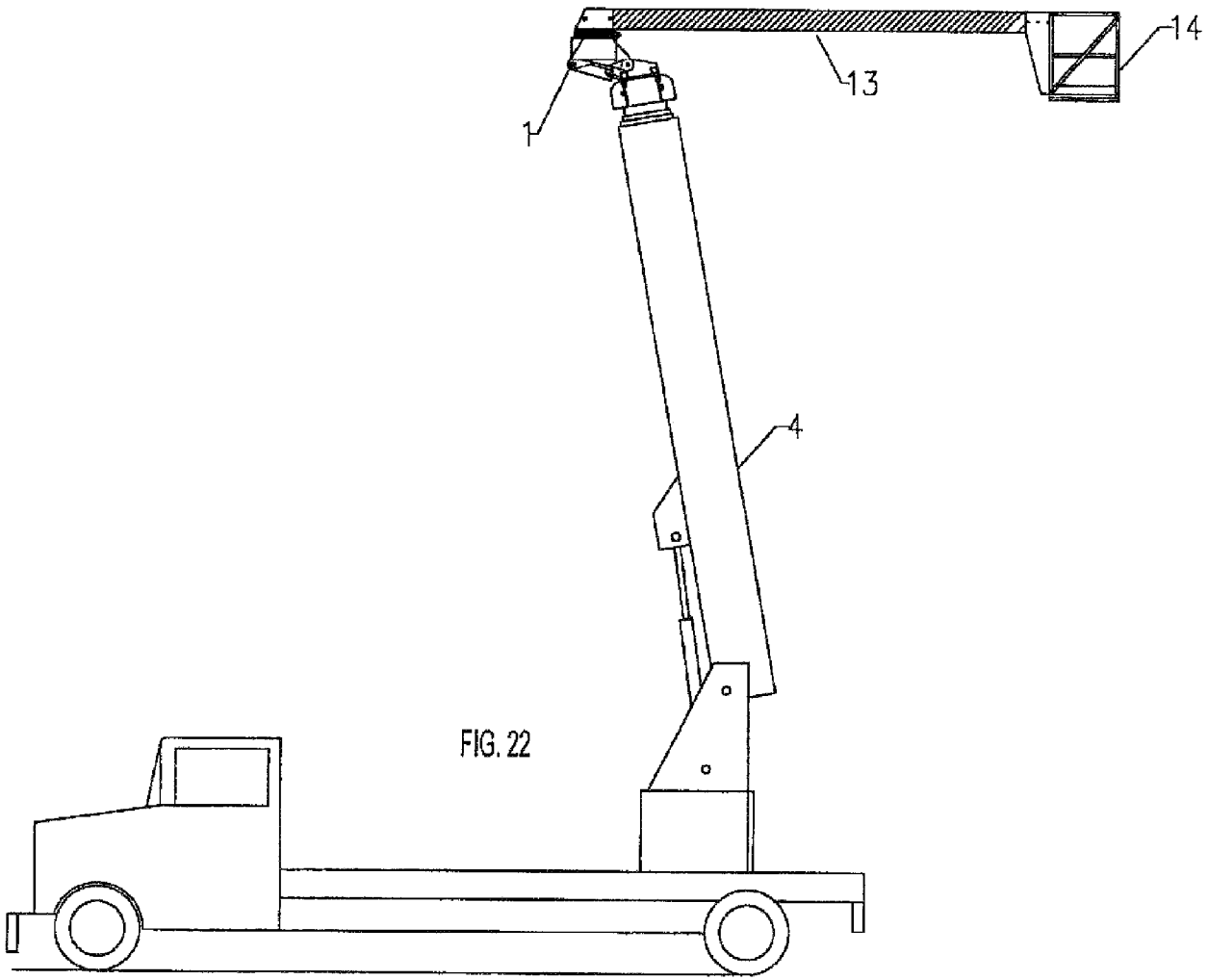
FIG. 22 is a side elevation view of the second preferred embodiment of present invention jib boom attachment with an optional work platform, and the fully-operational mobile telescopic boom crane truck to which it is connected having its main crane boom articulated upwardly at an approximate 80-degree angle relative to the ground under the truck, the present invention jib boom attachment and work platform still positioned level with the ground as a result of its linear leveling actuator locked and holding the level position, or continually maintaining the top of the jib boom rotation base in the level orientation displayed.

FIGS. 19-22 show various views of a dielectric insulated jib boom attachment 1 with work platform 14. The dielectric insulated material used in association with jib boom attachment 1 and work platform 14 may be dielectric insulated fiber glass, but not limited thereto. In the side elevation and top views shown in FIGS. 19 and 20, dielectric insulated jib boom tube 13 and work platform 14 are in substantially parallel stowed positions alongside main crane boom 4 and within the envelope required for road-legal-travel. In contrast, the top and side elevation views of FIGS. 21A and 21B show dielectric insulated jib boom tube 13 and work platform 14 in a non-parallel stowed position non-parallel to main crane boom 4, wherein dielectric insulated jib boom tube 13 and work platform 14 are lowered toward the truck bed supporting main crane boom 4 to place dielectric insulated work platform 14 close enough to the truck bed so that personnel have easy access to dielectric insulated work platform 14 without having to use a ladder. FIG. 22 shows dielectric insulated jib boom attachment 1 with work platform 14 and the fully-operational mobile telescopic boom crane truck to which it is connected having its main crane boom 4 articulated upwardly at an approximate 80-degree angle relative to the ground under the truck, the present invention jib boom attachment 1 and work platform 14 still positioned level with the ground as a result of its linear leveling actuator 7 locked and holding the level position, or continually maintaining the top of the jib boom rotation base 8 in the level orientation displayed. When the planar bottom surface of jib boom rotation base 8 is level, the associated components of jib boom assembly attachment 1 (rotation bearing drive assembly 10, platform support structure 12, and jib boom tube 13) will also be level. As also seen in FIG. 22, as long as the rotation bearing drive assembly 10 mounted to jib boom rotation base 8 is level, jib boom support structure 12 and jib boom tube 13 will also be level as they are fastened to the same geometric plane (which is in parallel orientation to that of the top surface of jib boom rotation base 8 that is connected to the lower/non-rotating portion of rotation bearing drive assembly 10). Furthermore, the optional work platform 14 when attached to end of jib boom tube 13 will also be level when attached to a level boom tube 13, regardless of the direction of rotation experienced by the combination of jib boom support structure 12, jib boom tube 13, and optional work platform 14. Jib boom tube 1, support structure 12 and jib boom attachment 1 are securely fastened together, and although work range and load capacity of jib boom attachment 1 are dependent upon the rated capacity of main crane boom 4, it is contemplated for a larger work platform attachment 1 associated with a 40-ton boom truck to support payload (not shown) weighing approximately 1500-pounds.

Figure 23:
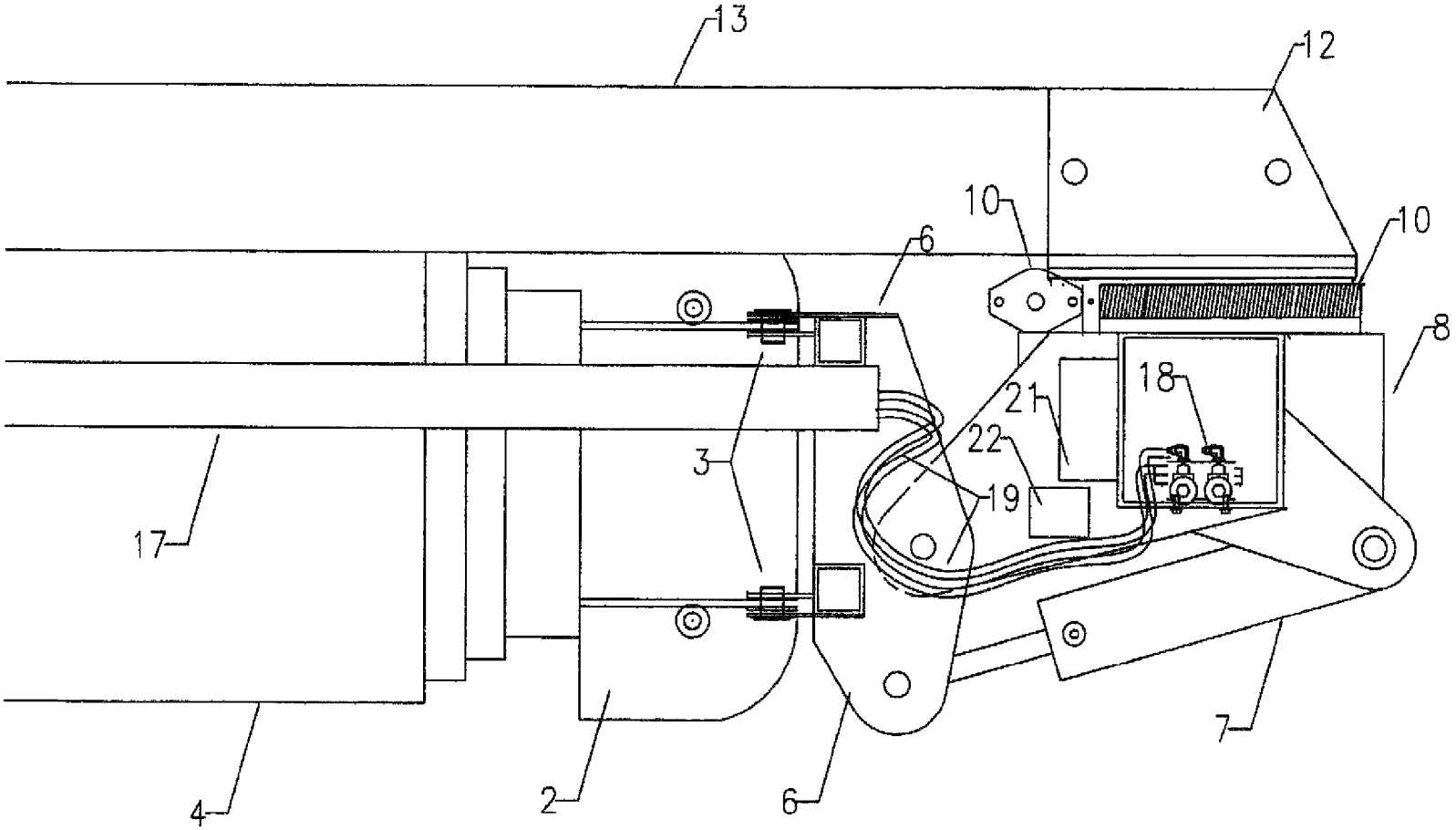
FIG. 23 is a side elevation view of a third preferred embodiment of present invention jib boom attachment similar to that shown in FIG. 12, which also has prompt pin attachment to swing-jig sheave head mounting plates and powered rotational and self-leveling capabilities, except that this jib boom attachment embodiment does not have the onboard hydraulic power package or battery power shown in FIG. 12, instead having its power supplied by the mobile crane's base vehicle or a remote source on the ground below via current state-of-the-art hose carrier systems or cable/hose reel systems (not shown) enabling power and/or hydraulics to reach the main crane boom sheave head tip for use by the present invention jib boom attachment and any connected work platform, with the auxiliary power unit and battery-powered power package) replaced by a hose carrier tube, wiring, and hydraulic control valves.

FIG. 23 is a side elevation view of a third preferred embodiment of present invention jib boom attachment similar to that shown in FIG. 12, which also has prompt mounting pin 3 attachment to swing-jig sheave head mounting plates 2 on main crane 4 and powered rotational and self-leveling capabilities, except that this jib boom attachment 1 embodiment does not have the onboard auxiliary power unit 24 and battery-powered power package 23, instead having its power supplied by the mobile crane's base vehicle or a remote source on the ground below via current state-of-the-art hose carrier systems or cable/hose reel systems (not shown) enabling power and/or hydraulics to reach the main crane boom 4 sheave head tip via hose carrier tube 17, wiring 19, and hydraulic control valves 18 for use by the present invention jib boom attachment 1 and any connected work platform 14. Although not shown and not limited thereto, an embodiment of the present invention connected to a main crane boom 4 without swing-jib sheave head mounting plates 2 could also use the same mechanical routing of hydraulic/electrical power shown in FIG. 23. Thus, whether the present invention jib boom attachment 1 is self-contained with onboard hydraulic-electric systems (as in FIG. 12) or has its operating power supplied to it by the mobile crane's base vehicle or a remote source on the ground (as in FIG. 23), use of the self-leveling present jib boom attachment 1 enables a crane boom truck to function as a modern state-of-art articulating aerial lift boom truck.

What is claimed is:

1. A powered jib boom attachment usable with mobile cranes, boom truck cranes, and telescopic boom assemblies having a telescopic crane boom with a distal tip, said jib boom attachment comprising:

a jib boom mounting bracket having a lower portion and fixed connection to the distal tip of a telescopic crane boom;

a jib boom rotation base in pivoting connection with said jib boom mounting bracket, allowing up and down vertical articulation of said jib boom rotation base relative to said jib boom mounting bracket, said jib boom rotation base having a bottom portion and a top surface positionable into a horizontal plane;

a rotation bearing drive assembly having an upper portion rotatable up to approximately 360-degrees relative to a lower portion, said lower portion having fixed connection with said top surface of said jib boom rotation base, said rotation bearing drive assembly fully operational to provide approximately 360-degrees of rotation regardless of the boom angle of an attached telescopic crane boom, said jib boom mounting bracket staying in fixed in orientation to the connected telescopic crane boom distal tip during all rotation of said rotation bearing drive assembly and while transferring bending and torsion loads from said jib boom member to the connected telescopic crane boom;

a jib boom support structure having fixed connection to said upper portion of said rotation bearing drive assembly, said jib boom support structure having a surface remote from said rotation bearing drive assembly in a geometric plane substantially parallel to that of said top surface of said jib boom rotation base, wherein when said top surface of said jib boom rotation base is in a horizontally-extending plane said surface of said jib boom support structure remote from said rotation bearing drive assembly is also in a horizontally-extending plane;

a jib boom member having an upper surface and fixed connection to said jib boom support structure that places said upper surface of said jib boom member in the same geometric plane of said surface of said jib boom support structure remote from said rotation bearing drive assembly; and a linear leveling actuator connected between said lower portion of said jib boom mounting bracket and said bottom portion of said jib boom rotation base, said connection of said linear leveling actuator to said jib boom mounting bracket below said pivoting connection of said jib boom rotation base to said jib boom mounting bracket, said linear leveling actuator having a cylinder articulating said bottom portion of said jib boom rotation base up and down in response to out-of-level orientations of said top surface of said jib boom rotation base resulting from out-of-level orientations in said upper surface of said jib boom member, said linear leveling actuator automatically extending and contracting different amounts in response to each instance of out-of-level positioning experienced by said jib boom member, with said extension and contraction being proportional to the amount of out-of-level positioning said jib boom member attains and also being commenced as often as needed to maintain said top surface of said jib boom rotation base in a horizontally-extending plane, said linear leveling actuator also extending and contracting while a telescopic crane boom having fixed connection to said jib boom mounting bracket is raised and lowered;

an electronic leveling sensor in fixed association with said jib boom rotation base and also in electrical communication with said linear leveling actuator; and power supply means adapted for providing power to operate said electronic leveling sensor and said linear leveling actuator, said power supply means associated with said jib boom rotation base and in electrical communication with said electronic leveling sensor and said linear leveling actuator, wherein when a change in load placed upon said jib boom member causes out-of-level positioning in said jib boom member and also in said jib boom support structure having fixed connection to said jib boom member, said top surface of said jib boom rotation base in a geometric plane substantially parallel to that of said jib boom support structure deviates from its horizontal plane, said electronic leveling sensor in fixed association with said jib boom rotation base senses said deviation and electrically communicates with said linear leveling actuator, causing said linear leveling actuator to automatically extend and contract a proportional amount in response and push or pull said jib boom rotation base an appropriate amount to cause said top surface of said jib boom rotation base, said jib boom support structure, and said jib boom member to regain level orientation in a horizontally-extending plane, with said automatic extension and contraction of said linear leveling actuator in response to out-of-level positioning in said jib boom member further occurring during articulation of the telescopic crane boom to which said jib boom mounting bracket has a fixed connection.

2. The jib boom attachment of claim 1 wherein said jib boom mounting bracket is further configured for pinned connection to pre-established mounting holes in swing-jib sheave head mounting plates that are part of a swing-jib mounting system secured to the distal tip of a telescopic crane boom without any adaptation or modification to the telescopic crane boom.

3. The jib boom attachment of claim 2 further comprising a plurality of swing-jib mounting pins provided by the manufacturer of the swing-jib mounting system secured to the distal tip of a telescopic crane boom, with said mounting pins complementary in size with the pre-established mounting holes and creating a secure connection between said jib boom mounting member and the swing-jib sheave head mounting plates of the swing-jib mounting system without any bolting, welding, or attachment of any other fixtures to the telescopic crane boom.

4. The jib boom attachment of claim 1 wherein linear leveling actuator is selected from a group consisting hydraulic-powered linear leveling actuators and electric-powered linear leveling actuators.

5. The jib boom attachment of claim 1 wherein said rotation bearing drive assembly is selected from a group consisting hydraulic-powered rotation bearing drive assemblies and electric-powered rotation bearing drive assemblies.

6. The jib boom attachment of claim 1 wherein said power supply means for said linear leveling actuator comprises a self-contained hydraulic power package with hydraulic reservoir and a direct current motor, at least one electric-hydraulic solenoid valve, and at least one deep-cycle large-amp-hour battery.

7. The jib boom attachment of claim 1 wherein said jib boom member is selected from a group consisting of jib boom members supported by stowage brackets connected to a telescopic crane boom during road-ready travel, jib boom members having substantially parallel positioning to a telescopic crane boom during road-ready travel, jib boom members positioned outboard to a telescopic crane boom during road-ready travel having substantially the same elevation of the telescopic crane boom, jib boom members having a jib boom mounting bracket remaining in full connection to a telescopic crane boom during road-ready travel, jib boom members having a jib boom mounting bracket in partial connection to a telescopic crane boom during road-ready travel, and jib boom members having an attached work platform and a jib boom mounting bracket remaining in full connection to a telescopic crane boom supported by a boom truck during road-ready travel, with the jib boom members in a lowered orientation placing the attached work platform close to the bed of the boom truck for quick access to the work platform by personnel on the truck bed.

8. The jib boom attachment of claim 7 further comprising a redundant ground-operated radio remote-control system performing leveling, articulation, and rotational functions for said jib boom member.

9. The jib boom attachment of claim 1 further comprising a work platform securely connected to said distal end of said jib boom member, and wherein said rotation bearing drive assembly produces sufficient rotation to place said jib boom member and said work platform member in a road-travel-ready stowed position outboard and parallel to a telescopic crane boom.

10. The jib boom attachment of claim 1 wherein said jib boom member can articulate approximately 90-degrees through a vertical plane.

11. The jib boom attachment of claim 1 wherein said jib boom member further comprises an attached work platform, and said jib boom member and said work platform have dielectric insulation allowing use of said jib boom member and said work platform for live power line maintenance work.

12. The jib boom attachment of claim 1 wherein said power supply means is selected from a group consisting self-contained power supplies onboard said jib boom attachment, power supplies providing electrical power supplied at least in part from the mobile boom crane or telescopic boom assembly supporting said jib boom attachment, power supplies providing hydraulic power supplied at least in part from the mobile boom crane or telescopic boom assembly supporting said jib boom attachment, power supplies providing power supplied at least in part from the mobile boom crane or telescopic boom assembly supporting said jib boom attachment via hose and cable carriers attached to telescopic crane boom supporting said jib boom attachment, remote power supplies providing power supplied at least in part from an auxiliary engine, and power supplies providing power supplied at least in part from a large battery-powered unit.

13. The jib boom attachment of claim 1 wherein at least one pivot pin provides said pivoting connection between said jib boom support structure and said jib boom rotation base.

14. The jib boom attachment of claim 1 wherein said rotation bearing drive assembly comprises a slewing ring bearing and an integral hydraulic self-locking worm gear drive mechanism that forces said jib boom support structure to rotate through a maximum range of approximately 360-degrees.

15. The jib boom attachment of claim 1 wherein said linear leveling actuator further comprises a safety locking mechanism that maintains a current linear positioning in the event of other failure during leveling of said jib boom member.

16. The jib boom attachment of claim 1 wherein said rotation bearing drive assembly further comprises a shear ball bearing and hydraulic gear drive mechanism allowing cantilevered mounting of said jib boom member in an offset position relative to a connected telescopic crane boom, with continuous level orientation being maintained for said jib boom member in all positions of rotation from 0-degrees to 360-degrees.

17. The jib boom attachment of claim 1 wherein said jib boom member has a compact design and configuration allowing it to remain pinned to the swing jib sheave head of a boom truck crane's boom while it is stowed over the truck's chassis cab, with said compact design and configuration causing said jib boom or optional work platform member to fit within the required height-and-width envelope for road-legal-travel while also preventing obstruction of a driver's windshield vision.

18. The jib boom attachment of claim 1 wherein said jib boom member has a jib sheave tip configured for fast and easy attachment of a work platform with plurality of mounting pins.

19. The jib boom attachment of claim 1 wherein said jib boom member has a compact design and configuration allowing it to remain pinned to the swing jib sheave head of a telescopic crane boom while stowed over the chassis cab of a truck supporting the telescopic crane boom, with said compact design and configuration causing said jib boom member to fit within the required height-and-width envelope for road-legal-travel while also preventing obstruction of a driver's windshield vision.

20. A powered jib boom attachment usable with mobile cranes, boom truck cranes, and telescopic boom assemblies having a telescopic crane boom with a distal tip, said jib boom attachment comprising:

a jib boom mounting bracket having a lower portion and fixed connection to the distal tip of a telescopic crane boom, said jib boom mounting bracket further configured for pinned connection to pre-established mounting holes in swing-jib sheave head mounting plates that are part of a swing-jib mounting system secured to the distal tip of a telescopic crane boom;

a jib boom rotation base in pivoting connection with said jib boom mounting bracket, allowing up and down vertical articulation of said jib boom rotation base relative to said jib boom mounting bracket, said pivoting connection provided by at least one pivot pin, said jib boom rotation base having a bottom portion and a top surface positionable into a horizontal plane;

a rotation bearing drive assembly having an upper portion rotatable up to approximately 360-degrees relative to a lower portion, said lower portion having fixed connection with said top surface of said jib boom rotation base, said rotation bearing drive assembly fully operational to provide approximately 360-degrees of rotation regardless of the boom angle of an attached telescopic crane boom, said jib boom mounting bracket staying in fixed in orientation to the connected telescopic crane boom distal tip during all rotation of said rotation bearing drive assembly and while transferring bending and torsion loads from said jib boom member to the connected telescopic crane boom;

a jib boom support structure having fixed connection to said upper portion of said rotation bearing drive assembly, said jib boom support structure having a surface remote from said rotation bearing drive assembly in a geometric plane substantially parallel to that of said top surface of said jib boom rotation base, wherein when said top surface of said jib boom rotation base is in a horizontally-extending plane said surface of said jib boom support structure remote from said rotation bearing drive assembly is also in a horizontally-extending plane;

a jib boom member having an upper surface and fixed connection to said jib boom support structure that places said upper surface of said jib boom member in the same geometric plane of said surface of said jib boom support structure remote from said rotation bearing drive assembly, said jib boom member also having articulation range through a vertical plane of approximately 90-degrees, and said jib boom member further has a jib sheave tip configured for fast and easy attachment of a work platform with plurality of mounting pins;

a linear leveling actuator connected between said lower portion of said jib boom mounting bracket and said bottom portion of said jib boom rotation base, said connection of said linear leveling actuator to said jib boom mounting bracket below said pivoting connection of said jib boom rotation base to said jib boom mounting bracket, said linear leveling actuator having a cylinder articulating said bottom portion of said jib boom rotation base up and down in response to out-of-level orientations of said top surface of said jib boom rotation base resulting from out-of-level orientations in said upper surface of said jib boom member, said linear leveling actuator automatically extending and contracting different amounts in response to each instance of out-of-level positioning experienced by said jib boom member, with said extension and contraction being proportional to the amount of out-of-level positioning said jib boom member attains and also being commenced as often as needed to maintain said top surface of said jib boom rotation base in a horizontally-extending plane, said linear leveling actuator also extending and contracting while a telescopic crane boom having fixed connection to said jib boom mounting bracket is raised and lowered, said linear leveling actuator further comprising a safety locking mechanism that maintains a current linear positioning in the event of other failure during leveling of said jib boom member;

an electronic leveling sensor in fixed association with said jib boom rotation base and also in electrical communication with said linear leveling actuator; and power supply means adapted for providing power to operate said electronic leveling sensor and said linear leveling actuator, said power supply means associated with said jib boom rotation base and in electrical communication with said electronic leveling sensor and said linear leveling actuator, wherein when a change in load placed upon said jib boom member causes out-of-level positioning in said jib boom member and also in said jib boom support structure having fixed connection to said jib boom member, said top surface of said jib boom rotation base in a geometric plane substantially parallel to that of said jib boom support structure deviates from its horizontal plane, said electronic leveling sensor in fixed association with said jib boom rotation base senses said deviation and electrically communicates with said linear leveling actuator, causing said linear leveling actuator to automatically extend and contract a proportional amount in response and push or pull said jib boom rotation base an appropriate amount to cause said top surface of said jib boom rotation base, said jib boom support structure, and said jib boom member to regain level orientation in a horizontally-extending plane, with said automatic extension and contraction of said linear leveling actuator in response to out-of-level positioning in said jib boom member further occurring during articulation of the telescopic crane boom to which said jib boom mounting bracket has a fixed connection.

* * * * *